US011326847B1

(12) United States Patent
Bango et al.

(10) Patent No.: US 11,326,847 B1
(45) Date of Patent: May 10, 2022

(54) APPARATUS, SYSTEM, AND METHOD FOR RESTRICTIVE OR SELECTIVE FIREARM AND SMART GUN WEAPON CONTROL

(71) Applicants: Joseph J. Bango, New Haven, CT (US); Michael Dziekan, Bethany, CT (US)

(72) Inventors: Joseph J. Bango, New Haven, CT (US); Michael Dziekan, Bethany, CT (US)

(73) Assignee: Connecticut Analytical Corporation, Bethany, CT (US)

( * ) Notice: Subject to any disclaimer, the term of this patent is extended or adjusted under 35 U.S.C. 154(b) by 0 days.

(21) Appl. No.: 17/165,352

(22) Filed: Feb. 2, 2021

Related U.S. Application Data

(60) Provisional application No. 62/991,276, filed on Mar. 18, 2020.

(51) Int. Cl.
*F41A 17/06* (2006.01)
*F41A 17/20* (2006.01)
*F41A 17/08* (2006.01)

(52) U.S. Cl.
CPC ..... *F41A 17/066* (2013.01); *F41A 17/063* (2013.01); *F41A 17/08* (2013.01); *F41A 17/20* (2013.01)

(58) Field of Classification Search
CPC ..... F41A 17/28; F41A 17/08; F41A 17/066; F41A 17/063; F41A 17/06
See application file for complete search history.

(56) References Cited

U.S. PATENT DOCUMENTS 5,966,859 A * 10/1999 Samuels ..... F41A 17/066 42/70.11
9,841,249 B1 * 12/2017 Nicks ..... H02J 7/00045
(Continued)

*Primary Examiner* — Joshua E Freeman
(74) *Attorney, Agent, or Firm* — Michael A. Black

(57) ABSTRACT

A firearm, the firearm comprising: a grip; a transparent window located on the rear of the grip; at least one electromagnetic sensor located within the grip, and configured to receive electromagnetic radiation from outside of the grip through the transparent window; a computing device located in the grip and in communication with the LED and the electromagnetic sensor; where the electromagnetic sensor is configured to detect incoming electromagnetic radiation traveling through the transparent window from outside of the grip; and the computing device is configured to allow the firearm to fire if the computing device determines that the incoming electromagnetic radiation corresponds to an authorized user for the firearm. A firearm system, the firearm comprising: an external charging circuit, the external charging circuit comprising: a resonant inductive coil; a power supply in operable communication with the coil; a rechargeable power storage device in operable communication with the coil; a firearm configured to removably connect to the external charging circuit, the firearm comprising: a resonant inductive coil; a power supply in operable communication with the coil; a rechargeable storage device in operable communication with the coil; firearm electronics in operable communication with the power supply; mechanical controls in operable communication with the power supply; a mechanical squeeze generator in operable communication with the power supply.

18 Claims, 23 Drawing Sheets

(56) References Cited

U.S. PATENT DOCUMENTS

| | | | | |
|---|---|---|---|---|
| 10,048,031 | B1 * | 8/2018 | Milde, Jr. | F41A 17/063 |
| 10,591,237 | B1 * | 3/2020 | Cannon | G01S 19/14 |
| 11,156,419 | B1 * | 10/2021 | Wang | F41C 23/22 |
| 11,178,241 | B2 * | 11/2021 | Gant | G07C 9/37 |
| 2007/0119088 | A1 * | 5/2007 | Newkirk | F41C 33/029 42/70.11 |
| 2007/0277420 | A1 * | 12/2007 | Newkirk | F41A 17/06 42/70.01 |
| 2016/0165192 | A1 * | 6/2016 | Saatchi | F41C 33/029 386/227 |
| 2016/0195352 | A1 * | 7/2016 | Pikielny | F41A 17/20 42/69.01 |
| 2017/0074611 | A1 * | 3/2017 | Winiecki | F41A 17/46 |
| 2017/0234641 | A1 * | 8/2017 | Farrell | F41A 17/46 434/16 |
| 2018/0045479 | A1 * | 2/2018 | Milde, Jr. | F41A 17/063 |
| 2018/0238649 | A1 * | 8/2018 | Winiecki | F41C 33/029 |
| 2020/0355457 | A1 * | 11/2020 | Deng | G01S 19/34 |
| 2021/0185138 | A1 * | 6/2021 | Gant | F41A 17/063 |

* cited by examiner

APPARATUS, SYSTEM, AND METHOD FOR RESTRICTIVE OR SELECTIVE FIREARM AND SMART GUN WEAPON CONTROL

BACKGROUND

The present invention relates generally to the field of firearms and in particular to smart gun technology. In addition, the present invention relates to user biometric identification.

DESCRIPTION OF RELATED ART

Over the past 40 years, there have been sporadic attempts to create what are known today as "smart gun" technologies. Some of the earliest concepts include requiring the user to wear a magnetic ring which, when placed into close contact with a trigger, moved a ferrous or magnetic lever that otherwise would impede trigger or hammer motion. As magnetic fields follow an inverse square law, any significant gap between the ring and the trigger or detection surface will preclude gun operation.

More recent concepts include embedding an RFiD or Radio Frequency Identification Device under the dermal or skin of an authorized firearm user. Still other approaches necessitate some means of biometric user identification; most commonly proposed being fingerprint verification. In prior art disclosures, a magnetic ring was required to be worn by the authorized firearm user, that when placed in contact with the firearm frame housing, would allow movement of a safety bar, permitting weapon discharge. Reliability of the system was discovered to be an issue, amongst other problems. In another prior art reference, an RFID chip was imbedded in the user, preferably in the hand. This approach suffers from the fact that power must be used to activate and interrogate the chip, and many potential smart gun users are averse to having anything implanted inside their body, especially an identification chip of any kind.

Previous iterations of "smart gun" technology utilize magnetic, or electronic rings, or other jewelry that is worn by the authorized individual. A person wearing such a ring or other piece of jewelry must never lose or damage this piece of jewelry. If they do, they will effectively become unarmed while holding a handgun. In addition, such items may be readily duplicated providing the opportunity for unauthorized use of the weapon. Even if an authorized individual has a miniature RFiD embedded into their hand, it could be remotely and clandestinely interrogated compromising the embedded access code to allow creation of a duplicate RFID key enabling unauthorized use. RF based links can also be electronically jammed or even permanently damaged using a higher power RF source. A clandestine high power source of RF could be set up under a table or under a countertop and send a damaging high power RF pulse into a persons hand without them even knowing it. When they went to reach for their "smart gun", they would find out rather quickly that their "smart gun" no longer works! As anyone who has ever used a Smartphone with a fingerprint reader knows, it takes about three or four tries before it finally works. Three or four times is fine for a Smartphone, but not so great for a "smart gun", especially when someone is running toward you with an axe or a gun screaming that they are going to kill you. In this case, you want a 100% reliable system that can't be jammed or interfered with. A person with an embedded RFiD could wear an electromagnetically shielded glove to protect their RFiD implant; however, the EM shielding would prevent the "smart gun" from accessing the RFiD. Not only that, any high power EM pulse could damage the "smart gun".

Many smart guns fail to adequately confirm the identification of an allowed user of the smart gun. Thus there is a need for an apparatus, system, and method for restrictive or selective firearm and smart gun weapon control that overcomes the above listed and other disadvantages.

SUMMARY

The disclosed invention relates to a firearm, the firearm comprising: a grip; a transparent window located on the rear of the grip; at least one electromagnetic sensor located within the grip, and configured to receive electromagnetic radiation from outside of the grip through the transparent window; a computing device located in the grip and in communication with the LED and the electromagnetic sensor; where the electromagnetic sensor is configured to detect incoming electromagnetic radiation traveling through the transparent window from outside of the grip; and the computing device is configured to allow the firearm to fire if the computing device determines that the incoming electromagnetic radiation corresponds to an authorized user for the firearm.

The invention also relates to a firearm system, the firearm comprising: an external charging circuit, the external charging circuit comprising: a resonant inductive coil; a power supply in operable communication with the coil; a rechargeable power storage device in operable communication with the coil; a firearm configured to removably connect to the external charging circuit, the firearm comprising: a resonant inductive coil; a power supply in operable communication with the coil; a rechargeable storage device in operable communication with the coil; firearm electronics in operable communication with the power supply; mechanical controls in operable communication with the power supply; a mechanical squeeze generator in operable communication with the power supply.

DETAILED DESCRIPTION

Figure 1:
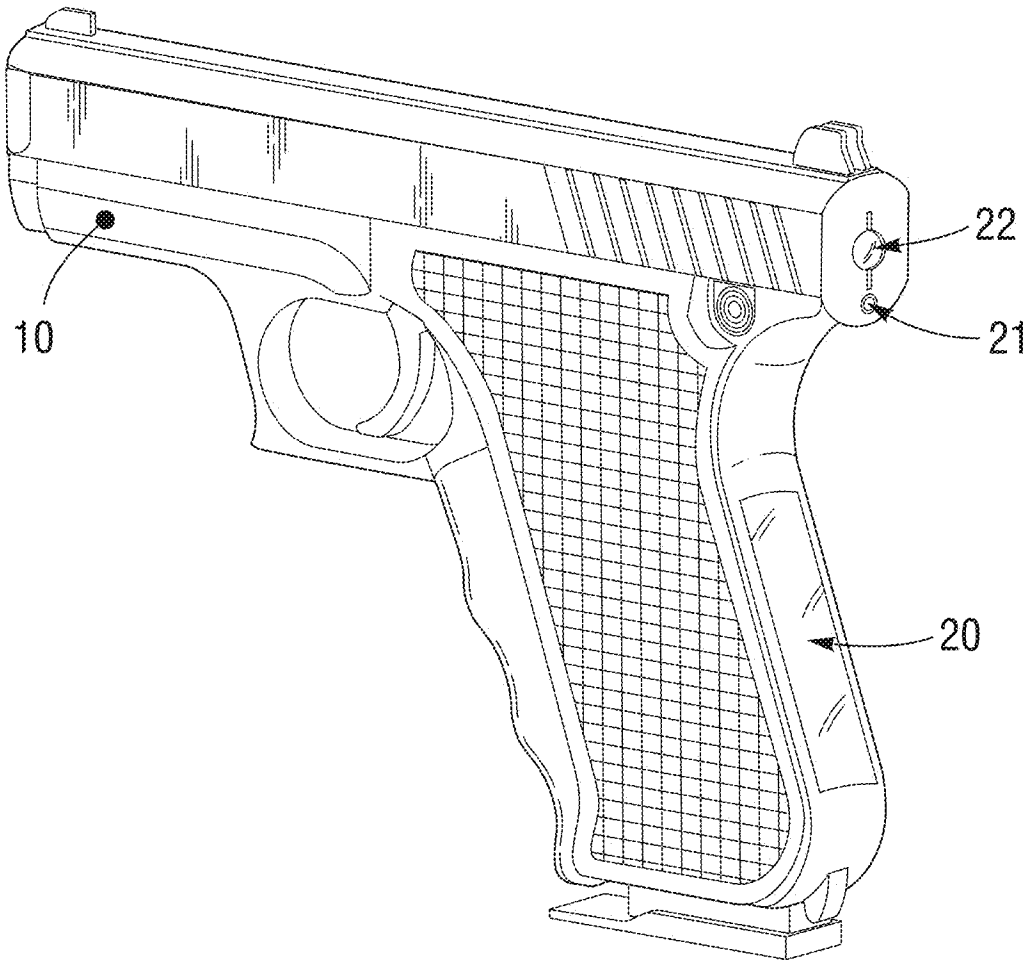
FIG. 1 shows a perspective view of one embodiment of the disclosed smart gun.

The presently disclosed inventive steps overcome the problems outlined above and advance the art by utilizing a combination of energy storage techniques and user identification methods that are both robust and reliable both in short term use, and in long term weapon storage.

The disclosed apparatus, system, and method for restrictive or selective firearm and smart gun weapon control offers a means to positively identify and approve, through electronic means, the firearm user identity. A smart gun, also called a smart-gun, or smartgun, is a firearm that can detect its authorized user or users.

One embodiment of the disclosed smart gun utilizes invisible ultraviolet ink that is embedded into an authorized users hand, right, left, or both. Anyone who has ever bought an item in virtually any store on Earth has noticed the ubiquitous barcode label affixed to the item. The described smart gun utilizes a barcode-like ultraviolet reflecting ink based tattoo that is permanently embedded into the authorized users palm area. The preferred embodiment of the described "smart gun" contains low power ultraviolet LED's (light emitting diodes), along with several ultraviolet sensors matched to the wavelength of the ultraviolet reflecting ink. The ultraviolet (UV) reflecting ink is invisible under visible wavelengths, and may only become "visible" when illuminated with a UV source of a specific, matched UV wavelength. The UV ink will not be "visible" to the naked eye, but only to a UV sensitive optical sensor. If the UV barcode were to fluoresce, i.e., if it were to reemit a lower wavelength light when illuminated with an invisible IV source, then this would have the unfortunate effect of making an easy undercover agent detector. The preferred embodiment of the disclosed smart gun will have UV reflective ink that is tattooed onto an authorized users palm on either hand of their choosing (or even both!) and it will not become visible to the naked eye when illuminated with invisible UV light. Only a sensor that is sensitive to the reflected invisible UV wavelengths will react to the invisible UV barcode like tattoo on the person's palm.

The disclosed smart gun provides for a reliable system that will only let authorized individuals fire the "smart gun"

One embodiment of the disclosed smart gun mitigates this potential problem by having a non-electronic, non-RF, non-magnetic, optical identification tattoo placed upon the authorized users palm. This described identification method is not susceptible to interference and all but impossible to compromise. The described smart gun is not susceptible to deliberately induced damage as any RF linked method is, and is more specific to an individual or group of users than magnetically linked alternatives that have been identified.

Another embodiment of the disclosed smart gun utilizes optical identification. Since it is only optical, and not RF, the "smart gun" can be 100% shielded from damaging EM pulses, and the UV reflecting ink would be unaffected by EM pulses or intense magnetic fields. The authorized individual will never have to worry about their "smart gun" key getting broken since the UV ink cannot be damaged or affected by EM pulses or intense magnetic fields. Only optical information is transmitted into the "smart gun" while it will be completely shielded from any RF signals. There is little chance of a "smart gun" being damaged or jammed from an external RF source.

There are many wavelengths of UV light, just as there are many wavelengths of visible red light. The visible spectrum spans approximately $700\times10^{-9}$ meters (red) to $400\times10^{-9}$ meters (violet). Some may argue that the visible spectrum extends to $390\times10^{-9}$ meters. For the sake of this patent, the UV spectrum starts at about $400\times10^{-9}$ meters. It is customary to specify wavelength in nanometers, abbreviated nm. A nanometer, or nm, is $10^{-9}$ meters.

Anyone who has bought suntan lotion may know that the suntan lotion (should) protect the user from UVA and UVB wavelengths of ultraviolet sunlight. There are three ultraviolet wavelength bands, labeled UVA, UVB, and UVC. UVA specifies the lowest energy ultraviolet wavelengths from 400 nm to 320 nm. UVB specifies the next highest energy ultraviolet wavelengths from 320 nm to 290 nm. UVC specifies the most dangerous and highest energy ultraviolet wavelengths from 290 nm to 100 nm. UVC is blocked by the earth's ozone layer, and would cause significant skin and eye damage were it not for the ozone layer. UVA and UVB penetrate through the ozone layer but are blocked by any decent quality suntan lotion. Approximately 95% of the sun's UV reaching the earth's surface is UVA, while the remaining 5% is UVB. No UVC reaches the earth's surface. People are continually bathed in UVA and UVB ultraviolet wavelengths during the day. It is interesting to note that even on a cloudy day; there can still be strong amounts of ultraviolet light that penetrates the clouds.

In another embodiment of the disclosed smart gun, the UV reflecting ink would reflect a small section of the UVA band of wavelengths. This is the UV that people are exposed to on a daily basis, and is the least harmful. The intensity of the ultraviolet wavelengths required is small compared to what we are exposed to by the sun each day. It is fairly easy and inexpensive to purchase UV LEDs that operate in this range of UV wavelengths. LED's also produce extremely narrow wavelengths in which a UV reflecting ink can be "tuned" to different agencies. The local police department may choose UV reflecting ink that reflects 375 nm, while the state police decide to go with 380 nm. The F.B.I may choose 360 nm. The important point here is that each agency can have custom tuned "smart guns".

Ultraviolet wavelengths are energetic, but can be attenuated by glass or plastic. In the preferred embodiment of the disclosed smart gun, a quartz window will allow for minimal optical attenuation between the UV LED's housed inside the "smart gun" and the authorized users hand.

For the "smart gun" to fire, several discrete actions may take place. The person who is holding the gun may have a barcode-like tattoo that has been produced with invisible UV reflecting ink that reflects strongly at the wavelength of the UV LED's housed within the "smart gun" grip. It may be preferred that a police force may choose to have a unified barcode-like UV reflecting tattoo that is given to every officer on the police force. In this situation, each officer on the force could pick up another officers service weapon and fire it if the need arises. With a single, unified tattoo that is specific to one particular police department, only members of that police department would be able to fire any of the "smart guns" specific to that police department. In other instances, it may be preferable that each officer has a unique barcode-like tattoo that corresponds to a single service weapon programmed to respond to that specific individual. The disclosed smart gun allows for either situation to be realized. Alternatively, the disclosed smart gun may use invisible IR (infrared) light to image the normally unseen vein structure embedded in a person's hand by using a combination of invisible IR wavelengths of light to image the normally invisible veins in the hand and visible wavelengths to image the minute lines and creases in the palm. A police force database would allow for each officers smart gun to contain their fellow officers palm print information, and thus allow each member of the specific police force to use each others smart guns. Since each user of the smart gun would be positively identified, a record of who actually fired the smart gun would be recorded. The police force may alternatively not want any other officer to use someone else's smart gun, and will then not add the additional palm print information to additional smart guns. By not adding additional palm print and vein structure images to the smart guns database, only the one authorized user will be able to fire the smart gun. There may be an instance where an officer retrieves another officer's smart gun from an incapacitated officer, and wishes to fire it. With remote access to the smart gun through WiFi or Bluetooth, the other officers palm print and vein structure image could be uploaded to the smart gun, and the other officer could now fire the smart gun.

For the "smart gun" to fire, the "smart gun" may be programmed to respond to a specific barcode-like UV tattoo that is tattooed onto an authorized user's palm. The "smart gun" will emit invisible UV from the gun grip and into the person's palm. If the UV reflecting ink is present, the invisible UV will be reflected back into the gun grip through the quartz window. A series of UV LED's and UV sensors will be embedded within the "smart gun" grip in such a fashion as to be stacked above each other that will allow a matched UV LED and UV sensor to resolve a thin line of UV reflecting ink. A pattern of thin lines will enable a person with a UV reflecting tattoo to be identified and will cause the "smart gun" to enable the gun to fire if the authorized individual pulls the trigger. If the UV LED is emitting UV into the palm of the person holding the "smart gun" and there is no UV reflecting, a small electromagnetic servo contained within the "smart gun" will enable an internal safety that will prevent the "smart gun" from firing. Only when the UV emitted from the "smart gun" grip is reflected back into the gun grip, and in the correct series of lines as in a barcode, will the "smart gun" disengage the internal safety and allow the "smart gun" to fire when the trigger is pulled.

There may be occasions where a police force may want specially trained individuals to operate special weapons. To facilitate this, a special weapon can contain the same UV LED's that emit at a different wavelength than the typical service weapon. A second invisible UV reflecting tattoo can be embedded into the person's palm that is offset from the original invisible UV reflecting tattoo. This second barcode-like tattoo will be programmed into the special "smart gun" weapon and allow the specially trained individual to operate it as well as their primary service weapon. If another individual who does not have the second invisible UV tattoo tries to operate the special "smart gun", the "smart gun" will look for the appropriate invisible UV tattoo and if it does not detect it, will set a small internal electromechanical safety to render the special "smart gun" inoperative until an authorized user with the appropriate invisible UV barcode-like tattoo operates it. When the designated individual with the appropriate invisible UV tattoo gets detected by the embedded UV sensors, the special "smart gun" will fire when the trigger is pulled. By having different "smart guns" that contain different invisible UV emitting LED's, a police force can custom tailor which trained individuals are allowed to use specific weapons.

Another embodiment of the described smart gun will allow a "smart gun" to fire if a barcode-like invisible UV tattoo has the correct series of lines and spaces. It should be obvious to those skilled in the art that a "smart gun" can be made more secure by containing a series of UV LED's that emit different UV wavelengths. In this instance, if someone wanted to counterfeit the "smart gun" invisible UV tattoo, the person would not only have to know the correct series of lines and spaces, but they would also need to know which invisible UV barcode-like lines are reflective to a specific UV wavelength. If the counterfeit invisible UV tattoo had the right invisible UV ink lines in the right geographical area, they would still have to know which invisible UV ink lines are reflective to the correct UV light source. Additionally, some UV inks could be absorptive as opposed to reflective, and return more UV in specific areas than others. This could be an added measure of security.

Another embodiment of the described smart gun will allow a "smart gun" to fire if a combination of 1R wavelengths identifying veins in the palm of the hand and a visible image of the lines and creases of the palm of the hand match a stored image in the smart guns internal database.

As anyone with even the most rudimentary knowledge of electronics knows, to illuminate an LED, power is required. To produce power to operate the LED's and the internal electronics, a long life rechargeable battery could be installed inside the "smart gun". A charging plug could be incorporated into the "smart gun" housing that plugs into a charging port of a police cruiser or cigarette lighter of any vehicle.

FIG. 1 shows a perspective view of a semi-automatic hand gun 10 with a modified hand grip 12 and a CCD camera 22. The optically transparent window 20 will allow the UV LED's to transmit electromagnetic radiation at a specific UV wavelength to pass through the window, while the reflected electromagnetic radiation can pass through the transparent window 20 back into the hand grip to be detected by the sensors. It is important to note that the sensors within the hand grip can detect electromagnetic radiation that will either be visible or invisible to the naked eye. It does not matter if the naked eye can detect the electromagnetic radiation reflected back from the person's palm, what is important is that the sensors within the hand grip can detect this electromagnetic radiation. Some law enforcement organizations may prefer a bar-code like tattoo that is visible to the naked eye, while other law enforcement organizations might prefer the invisible bar-code like tattoo remain invisible to the naked eye when illuminated with UV wavelengths of electromagnetic radiation. In situations where a law enforcement officer might be working undercover, it would be much more cautious if the invisible UV bar-code like tattoo remains invisible to the naked eye when illuminated with UV electromagnetic radiation.

It is important to point out that there are certain chemicals that can emit electromagnetic radiation in the visible portion of the electromagnetic spectrum when illuminated with electromagnetic radiation from the invisible portion of the electromagnetic spectrum. Such as a process known as fluorescence. Fluorescence is the emission of electromagnetic radiation or light by a substance that has absorbed electromagnetic radiation or light. It is a form of photoluminescence. In most cases, the emitted light has a longer wavelength, and therefore lower energy, than the absorbed radiation. However, when the absorbed electromagnetic radiation is intense, it is possible for one electron to absorb two photons; this two-photon absorption can lead to emission of radiation having a shorter wavelength than the absorbed radiation. The emitted radiation may also be of the same wavelength as the absorbed radiation, termed "resonance fluorescence". Fluorescence occurs when an orbital electron of a molecule or atom relaxes to its ground state by emitting a photon of light after being excited to a higher quantum state by some type of energy. The most striking examples of fluorescence occur when the absorbed radiation is in the invisible region of the electromagnetic spectrum, such as ultraviolet—invisible to the human eye—and the emitted light is in the visible region.

Another embodiment of the disclosed smart gun will utilize basic reflectance of invisible inks, that when suitably illuminated with a compatible invisible electromagnetic illumination source, will reflect the same wavelength. In this manner, the invisible bar-code like tattoo will remain invisible to the naked eye, but will be easily detectable with a suitable electromagnetic sensor. In another embodiment of the disclosed smart gun, the process of fluorescence will be utilized where the palm is suitably illuminated with invisible electromagnetic radiation illumination source and the ink in the invisible tattoo will reflect at a lower wavelength. In this manner, the invisible bar-code like tattoo will become visible to the naked eye, as well as being easily detectable with a suitable electromagnetic sensor.

One embodiment of the disclosed smart gun can comprise a tri-color led 21 that works in conjunction with an electromagnetic sensor (not visible in the drawing) that will alert the owner of the smart gun that they are aiming the smart gun at a law enforcement individual who is wearing an electromagnetic strobe unit. The electromagnetic strobe unit may be within the visible spectrum, and easily seen by the naked eye or it may be outside of the visible spectrum, and invisible to the naked eye. It is important to note that the electromagnetic sensor can be provide analog information to the microcontroller that will enable the microcontroller to analyze the intensity of the received electromagnetic radiation as well as any temporal patterns that would be indicative of a law enforcement agency. If the smart gun's front facing electromagnetic sensor with narrow field of view is not detecting any law enforcement individual who is wearing an electromagnetic strobe unit, the tricolor led 21 will periodically flash green. If the smart gun's front facing electromagnetic sensor with narrow field of view is periodically detecting law enforcement individuals that are wearing an electromagnetic strobe unit, the tricolor led 21 will periodically flash yellow to alert the smart gun holder that there are law enforcement individuals around them. If the smart gun's front facing electromagnetic sensor with narrow field of view is pointed directly at law enforcement individuals that are wearing an electromagnetic strobe unit, the tricolor led 21 will quickly flash red to alert the smart gun holder that they are pointing their gun directly at one of their own. The smart gun will have a law enforcement model that will have this information made available to the smart gun user, and a civilian model that will have in addition to the flashing tri-color led 21 the ability for the smart guns trigger to be disabled if the flashing tri-color led 21 is flashing yellow or red. This will prevent a civilian from shooting law enforcement individual. The law enforcement smart gun will alert the smart gun owner that they are pointing the smart gun in the vicinity of a fellow law enforcement individual, but there may be a situation where an armed suspect is standing in close proximity to a law enforcement individual, and the law enforcement individual holding the smart gun will be able to use their training to see if they can made a clean shot without endangering another law enforcement individuals life. The rear facing CCD camera 22 can perform facial recognition in addition to the invisible ink hand analysis for added security.

Figure 2:
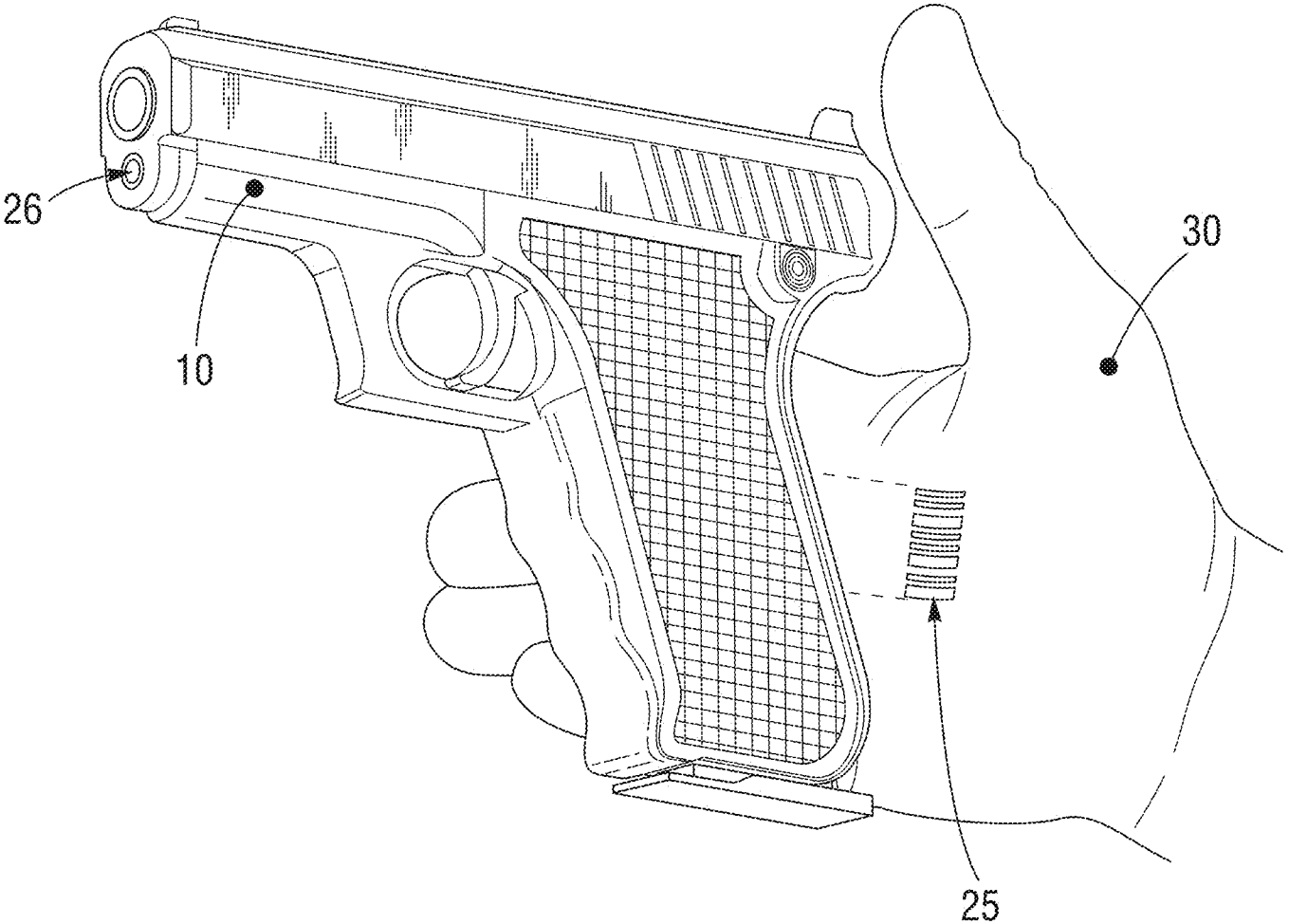
FIG. 2 the smart gun from FIG. 2 and a person's palm a small distance away from the smart gun.

FIG. 2 shows a perspective view of a semi-automatic hand gun 10 with a modified hand grip utilizing a transparent window built into the hand grip and a representative section of a person's palm 30 shown a short distance from the gun grip. The smart gun contains a forward facing, narrow field of view electromagnetic sensor 26 that will be able to check for visible and invisible wavelengths of electromagnetic radiation that law enforcement agencies may use during coordinated operations. The forward facing, narrow field of view electromagnetic sensor 26 that will provide an analog signal to the smart guns microcontroller to make a positive identification as to if the electromagnetic signal is the result of a known law enforcement pattern stored in the smart guns database. The smart gun will have the ability to connect to the internet and the World Wide Web through the use of either WiFi or Bluetooth. When the smart gun is connected to the internet and/or the World Wide Web, the smart guns internal database can be updated with new information, such as to new law enforcement strobe wavelengths and temporal patterns.

The optically transparent window will allow the UV LED's to transmit electromagnetic radiation at a specific UV wavelength to pass through the window, while the reflected electromagnetic radiation can pass through the transparent window back into the hand grip to be detected by the smart guns sensors. It is important to note that the sensors within the hand grip can detect electromagnetic radiation that will either be visible or invisible to the naked eye. It does not matter if the naked eye can detect the electromagnetic radiation reflected back from the person's palm 30, what is important is that the sensors within the hand grip can detect this electromagnetic radiation. A representative section of a person's palm 30 is shown to indicate the relative placement of an invisible bar-code like tattoo implanted on the person's palm 25. When not illuminated with a suitable source of electromagnetic radiation, such as ultraviolet, the invisible inks used in the bar-code like tattoo 25 will remain invisible. Although wavelengths of light within the ultraviolet portion of the electromagnetic spectrum are utilized in the preferred embodiment of the disclosed smart gun, different portions of the electromagnetic spectrum could be utilized, such as visible or invisible infrared.

Figure 3:
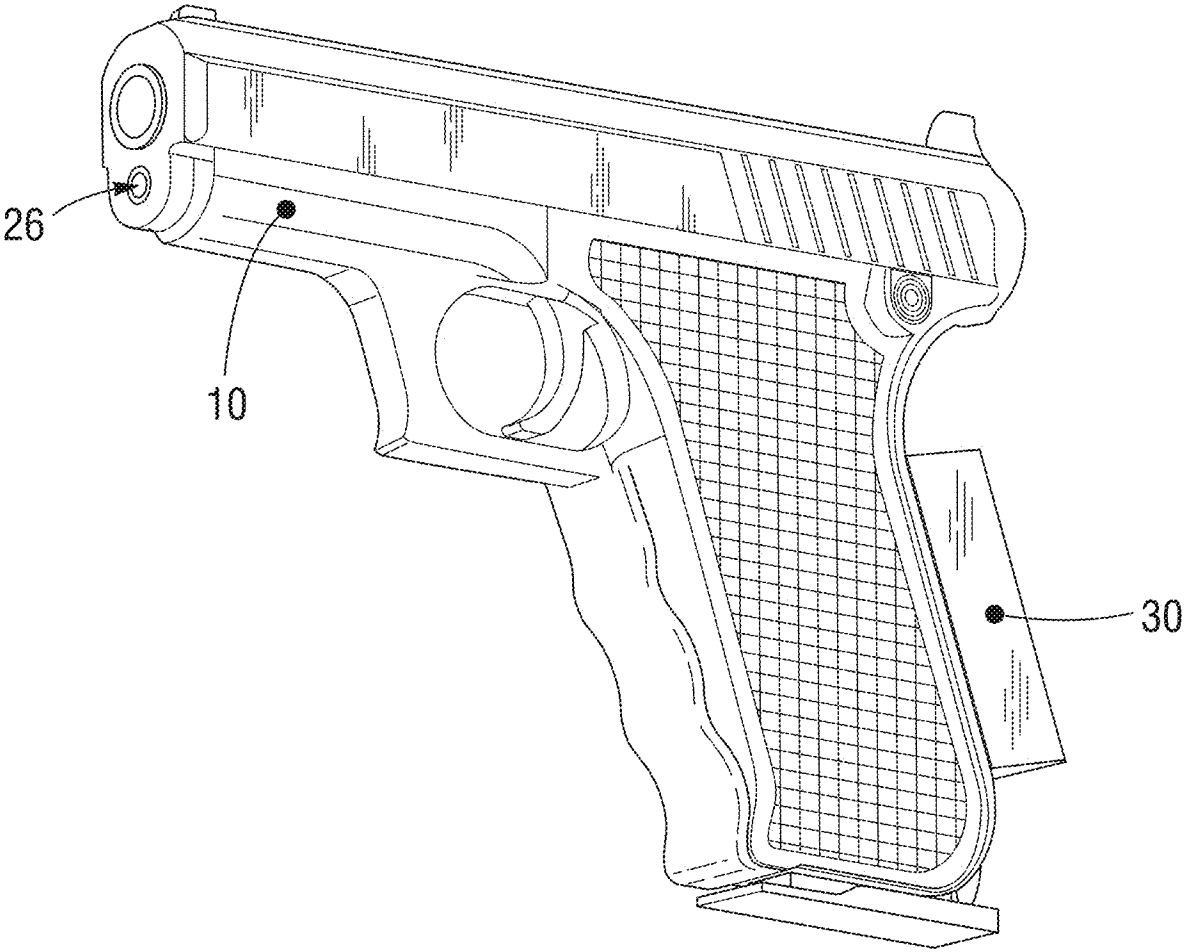
FIG. 3 shows the smart gun from FIG. 2 with a representation of a section of a person's palm in contact with the smart gun.

FIG. 3 shows a perspective view of a semi-automatic hand gun 10 with a modified hand grip utilizing a transparent window built into the hand grip and a representative section of a person's palm 30 shown a in contact with the gun grip. Only a small representative section of a person's palm 30 is shown so details will not be obscured, as drawing a full palm would cover important portions of the drawing. The optically transparent window will allow the UV LED's to transmit electromagnetic radiation at a specific UV wavelength to pass through the window, while the reflected electromagnetic radiation can pass through the transparent window back into the hand grip to be detected by the sensors. It is important to note that the sensors within the hand grip can detect electromagnetic radiation that will either be visible or invisible to the naked eye. It does not matter if the naked eye can detect the electromagnetic radiation reflected back from the person's palm 30, what is important is that the sensors within the hand grip can detect this electromagnetic radiation. A section of a person's palm 30 is shown to indicate the relative placement with the gun grip. When not illuminated with a suitable source of electromagnetic radiation, such as ultraviolet, the invisible inks used in the bar-code like tattoo will remain invisible. Although wavelengths of light within the ultraviolet portion of the electromagnetic spectrum are utilized in the preferred embodiment of the disclosed smart gun, different portions of the electromagnetic spectrum could be utilized, such as visible or invisible infrared. The smart gun contains a forward facing, narrow field of view electromagnetic sensor 26 that will be able to check for visible and invisible wavelengths of electromagnetic radiation that law enforcement agencies may use during coordinated operations. The forward facing, narrow field of view electromagnetic sensor 26 that will provide an analog signal to the smart guns microcontroller to make a positive identification as to if the electromagnetic signal is the result of a known law enforcement pattern stored in the smart guns database.

Figure 4:
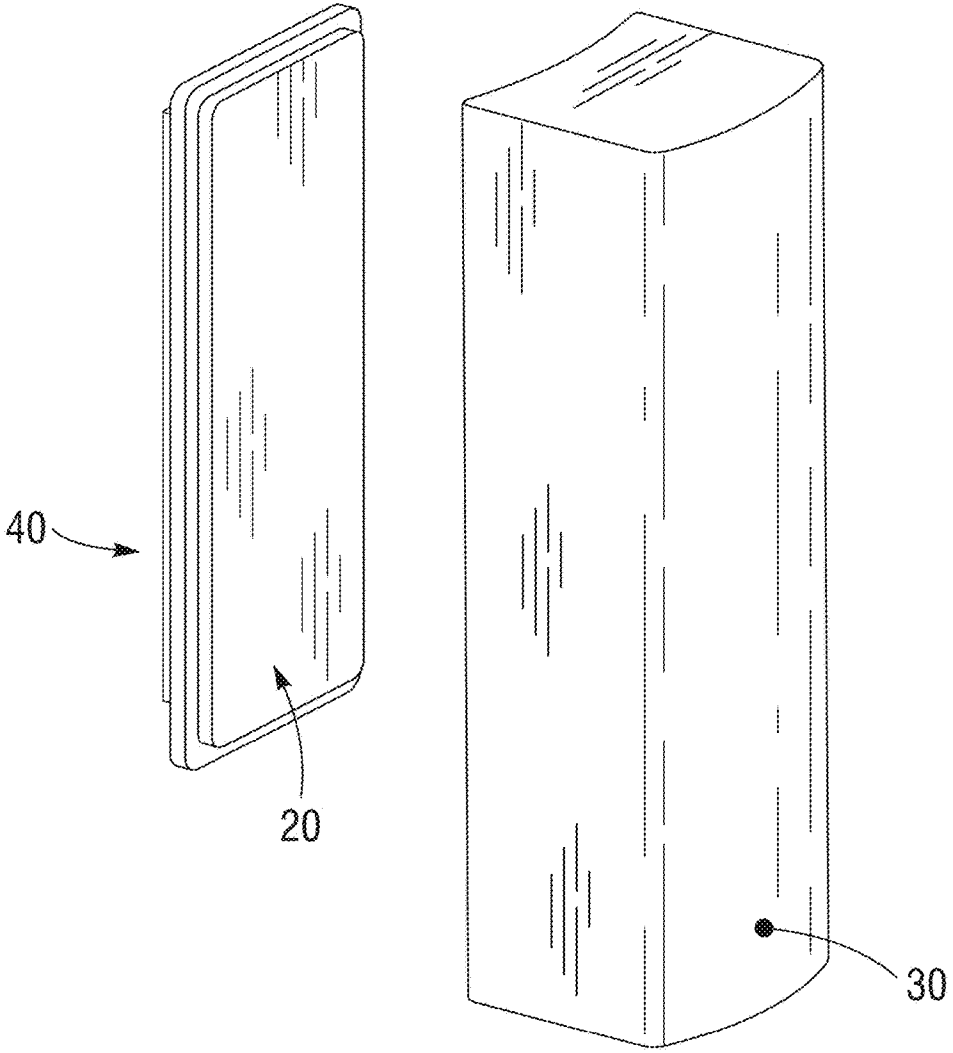
FIG. 4 shows a perspective view of the transparent section of the smart gun as well as a representation of a section of a person's palm shown a short distance away from the grip.

FIG. 4 details the transparent window 20 portion of the gun grip as well as the plurality of LED's and electromagnetic sensors 40 housed within the gun grip. It is important to note that the sensors within the hand grip can detect electromagnetic radiation that will either be visible or invisible to the naked eye. It does not matter if the naked eye can detect the electromagnetic radiation reflected back from the person's palm 30, what is important is that the sensors within the hand grip can detect this electromagnetic radiation. A representative section of a person's palm 30 is shown to indicate the relative placement with the gun grip. When not illuminated with a suitable source of electromagnetic radiation, such as ultraviolet, the invisible inks used in the bar-code like tattoo will remain invisible.

Figure 5B:
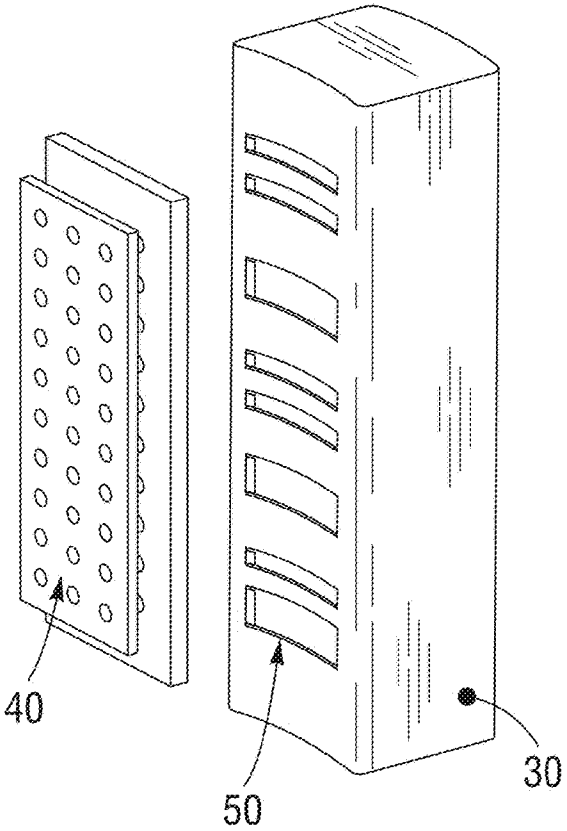
FIG. 5B is a drawing depicting the back side of the transparent section of the hand gun as well as a representation of a section of a person's palm shown a short distance away from the gun grip, but the bar-code like tattoo is visible.
Figure 5A:
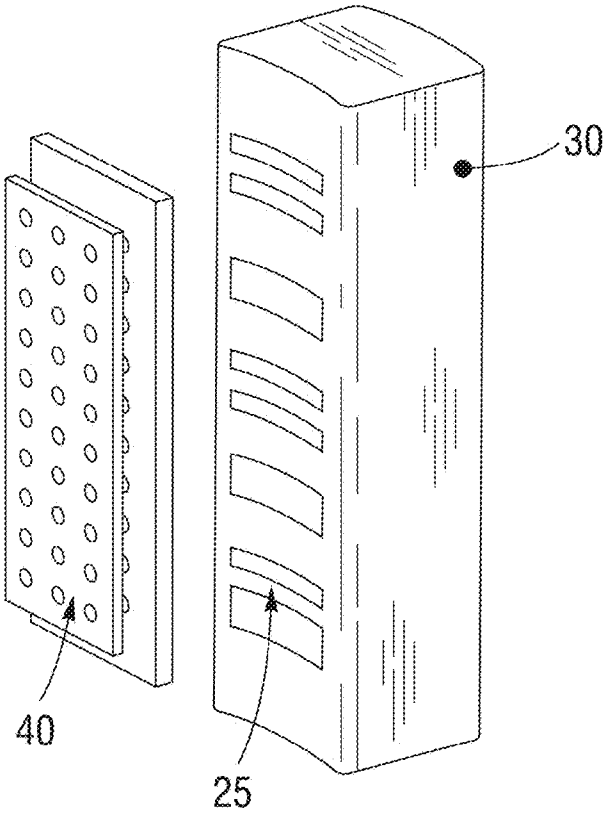
FIG. 5A is a drawing depicting the back side of the transparent section of the hand gun as well as a representation of a section of a person's palm shown a short distance away from the gun grip and one section of palm has the bar-code like invisible tattoo.

FIGS. 5A and 5B detail the back side of the transparent window portion of the gun grip's plurality of LED's and electromagnetic sensors 40 housed within the gun grip. It is important to note that the sensors within the hand grip can detect electromagnetic radiation that will either be visible or invisible to the naked eye. It does not matter if the naked eye can detect the electromagnetic radiation reflected back from the person's palm 30, what is important is that the sensors within the hand grip can detect this electromagnetic radiation. A representative section of a person's palm 30 is shown to indicate the relative placement of an invisible bar-code like tattoo implanted on the person's palm 25. When not illuminated with a suitable source of electromagnetic radiation, such as ultraviolet, the invisible inks used in the bar-code like tattoo 25 will remain invisible to the naked eye. When illuminated with a suitable source of electromagnetic radiation, such as ultraviolet, the invisible inks used in the bar-code like tattoo 50 may become visible to the naked eye, but the invisible ink may simply reflect back the invisible wavelengths and will still be invisible to the naked eye. This is done to ensure that a law enforcement individual that is working undercover will not have their cover blown if an ultraviolet light source is shone on their hand. Although wavelengths of light within the ultraviolet portion of the electromagnetic spectrum are utilized in the preferred embodiment of the disclosed smart gun, different portions of the electromagnetic spectrum could be utilized, such as visible or invisible infrared. It is important to understand that instead of a invisible bar code, an rfid (Radio Frequency Identification) chip could be embedded in the persons hand, where a low power rf from the smart gun will communicate with the rfid chip and not be impeded by someone wearing a glove.

Figure 6:
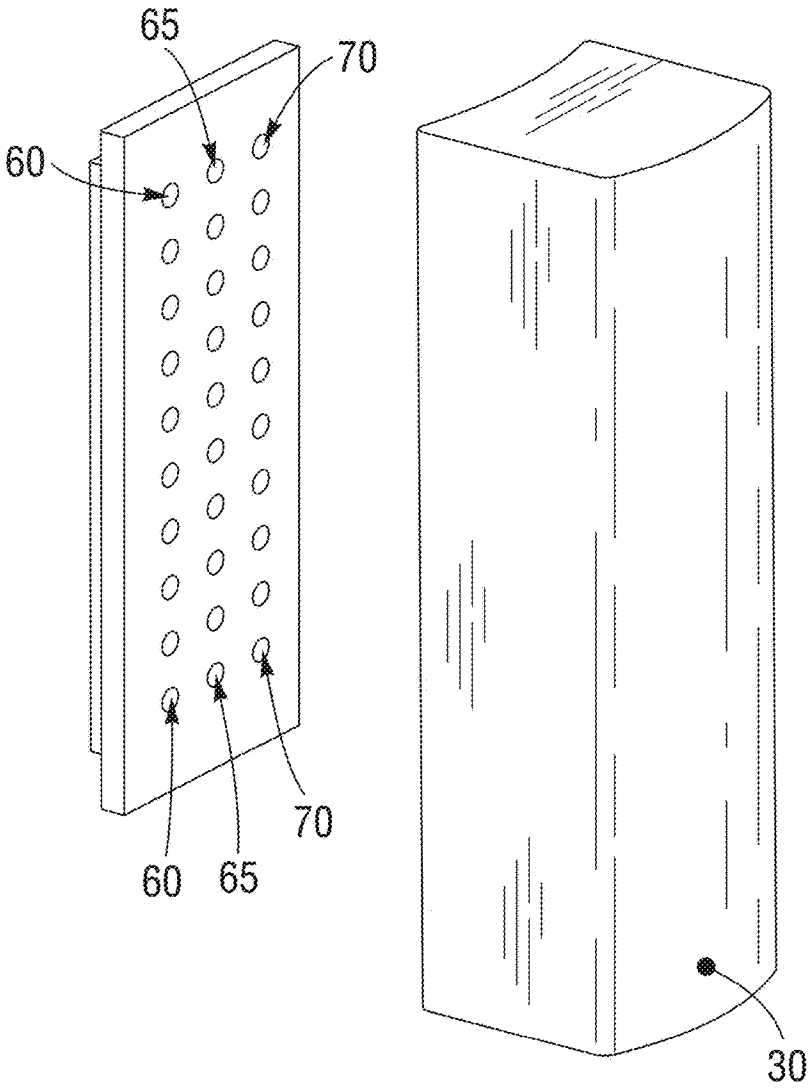
FIG. 6 is a drawing depicting the transparent section of the hand gun with the optically transparent window removed to show the LED's as well as the optical sensors. There is also a representation of a section of a person's palm shown a short distance away from the gun grip.

FIG. 6 details a representative section of a person's palm 30 that is shown a short distance away from the LED's 70 and electromagnetic sensors 65. The short distance is for the sake of clarity so the reader can see the LED's and electromagnetic sensors that would otherwise be blocked from view. In the preferred embodiment of the disclosed smart gun, there is more than one wavelength utilized. This is a security measure so that several different invisible inks could be utilized to thwart individuals from counterfeiting a bar-code like tattoo to operate an unauthorized hand gun. In the preferred embodiment of the disclosed smart gun, there are several rows of UV LED's, where each column has a different wavelength. In one column, the UV LED's 60 have one wavelength while the other column contains UV LED's 70 that have a slightly different wavelength. A column of electromagnetic sensors 65 would be placed between the two columns of UV LED's 60, 70. It is important to note that the individual UV LED's may be strobed one at a time to conserve power. It is also important to note that when each UV LED is activated, it will be pulsed on and off quickly in a pseudo-random fashion.

Figure 7B:
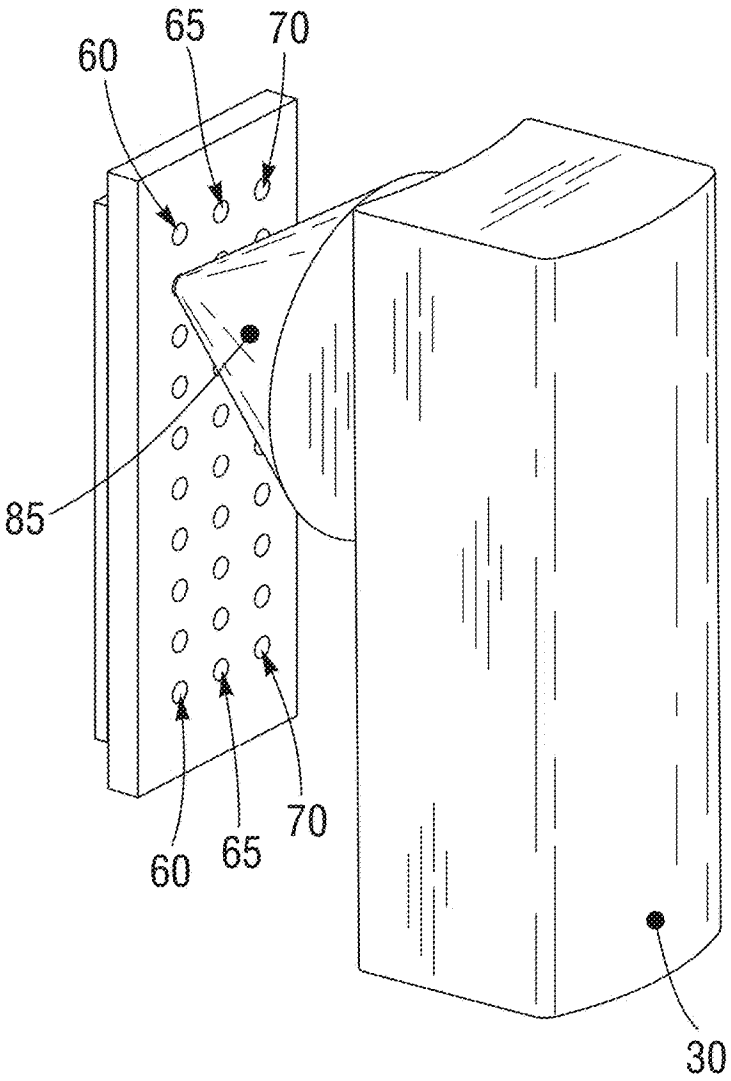
FIG. 7B is a drawing depicting the transparent section of the hand gun with the optically transparent window removed to show the LED's (with two actively illuminating the palm) as well as the optical sensors. There is also a representation of a section of a person's palm shown a short distance away from the gun grip.
Figure 7A:
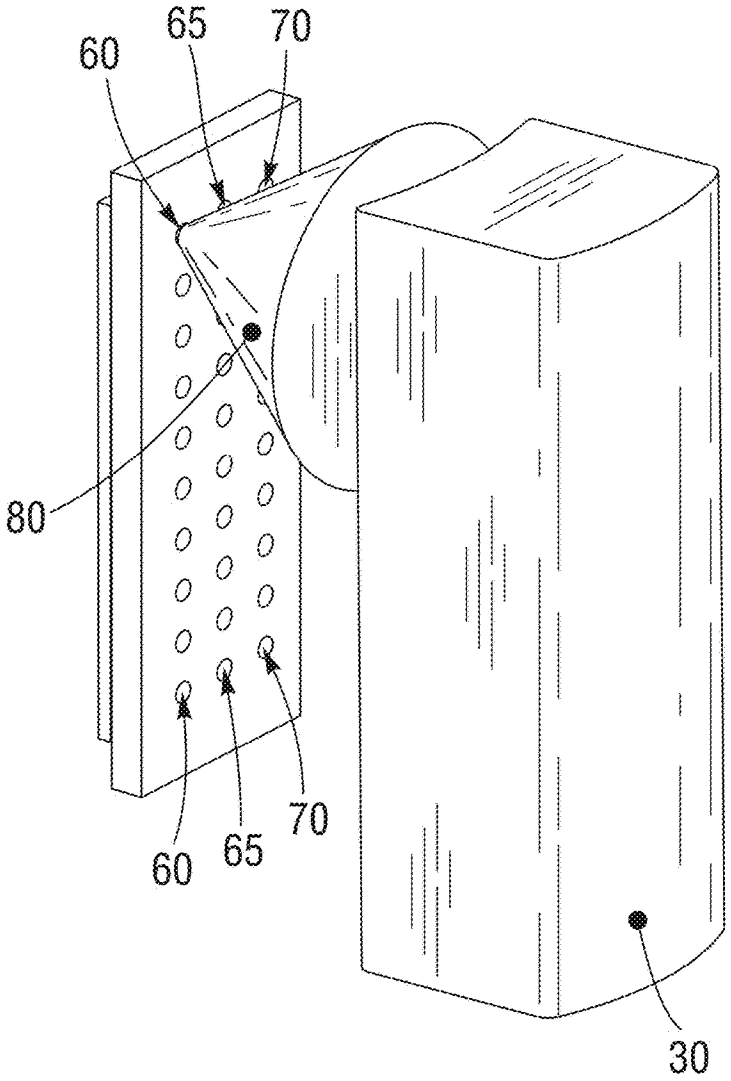
FIG. 7A is a drawing depicting the transparent section of the hand gun with the optically transparent window removed to show the LED's (with two actively illuminating the palm) as well as the optical sensors. There is also a representation of a section of a person's palm shown a short distance away from the gun grip.

FIGS. 7A and 7B detail a representative section of a person's palm 30 that is shown a short distance away from the LED's and electromagnetic sensors. The short distance is for the sake of clarity so the reader can see the LED's and electromagnetic sensors that would otherwise be blocked from view. In the preferred embodiment of the disclosed smart gun, there is more than one wavelength utilized. This is a security measure so that several different invisible inks could be utilized to thwart individuals from counterfeiting a bar-code like tattoo to operate an unauthorized hand gun. In the preferred embodiment of the disclosed smart gun, there are two columns of UV LED's 60, 70, where each column has a different wavelength. In one column, the UV LED's 60 have one wavelength while the other column contains UV LED's 70 that have a slightly different wavelength. A column of electromagnetic sensors 65 would be placed between the two columns of UV LED's. It is important to note that the individual UV LED's will be strobed one at a time to conserve power. It is also important to note that when each UV LED is activated, it will be pulsed on and off quickly in a pseudo-random fashion. As one UV LED is activated "A", a cone of electromagnetic radiation 80 is shown being emitted from the active UV LED. A short time later, the next UV LED in the same column is activated, "B", and a cone of electromagnetic radiation 85 is shown being emitted from the UV LED. This process repeats with the next subsequent UV LED being activated until each of the two columns have had their individual UV LED's activated. It is obvious to those skilled in the art that instead of utilizing UV LED's in conjunction with electromagnetic sensors, an array of purely passive infrared electromagnetic sensors could be utilized to form a "thermal palm print" of a persons palm to generate a unique identifier for the smart gun. In this way, all the UV LED's indicated in the drawing may be replaced with infrared sensitive sensors, and an thermal image of a persons palm (without need of a UV invisible ink tattoo) can produce a similar desired result of uniquely identifying an individual whose thermal palm print is stored in the smart guns electronics.

Although one embodiment of the disclosed smart gun describes the necessity for invisible bar-code like tattoos, the unique lines and folds of a persons own palm could be captured by a CCD (Charged Coupled Device) and will be converted into a "finger print like" pattern for a specific person. This would allow a small digital camera, such as that which is ubiquitous in virtually every smart phone to analyze a person's unique lines, folds, and colorations to be stored in the smart guns memory. If a CCD camera is utilized within the gun grip, it is also possible to capture a person's facial image to verify identity of the user. Similar things are being done with smart phones to verify credit card transactions online. A person enters their credit card information and then snaps a live picture of their face with the smart phone to verify identity. A similar process can be done with the disclosed smart gun.

In yet another embodiment of the disclosed smart gun, the hand gun will have a small key pad or series of buttons built into the smart gun that will allow the user to enter a short, unique code into the smart gun to "unlock" the smart gun for use.

Figure 8:
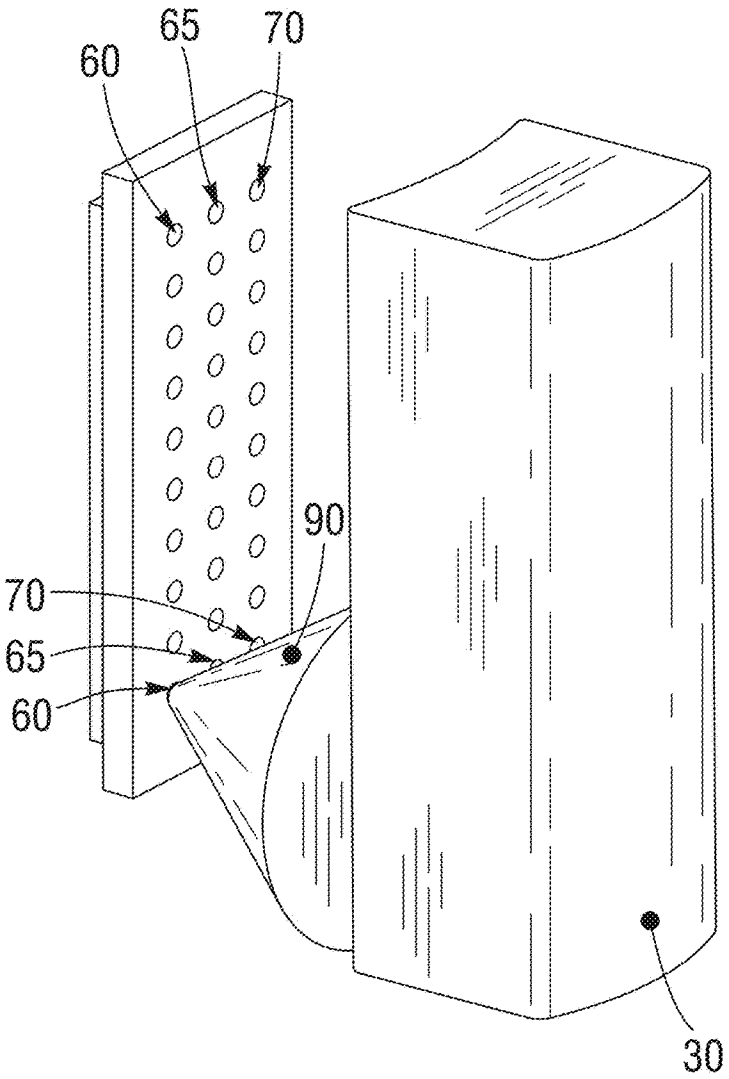
FIG. 8 is a drawing depicting the transparent section of the hand gun with the optically transparent window removed to show the LED's (with one actively illuminating the palm) as well as the optical sensors. There is also a representation of a section of a person's palm shown a short distance away from the gun grip.

FIG. 8 details a representative section of a person's palm 30 that is shown a short distance away from the LED's and electromagnetic sensors. The short distance is for the sake of clarity so the reader can see the LED's and electromagnetic sensors that would otherwise be blocked from view. In the this embodiment of the disclosed smart gun, there is more than one wavelength utilized. This is a security measure so that several different invisible inks could be utilized to thwart individuals from counterfeiting a bar-code like tattoo to operate an unauthorized hand gun. In this embodiment of the disclosed smart gun, there are two columns of UV LED's, where each column has a different wavelength. In one column, the UV LED's 60 have one wavelength while the other column contains UV LED's 70 that have a slightly different wavelength. A column of electromagnetic sensors 65 would be placed between the two columns of UV LED's. It is important to note that the individual UV LED's will be strobed one at a time to conserve power. It is also important to note that when each UV LED is activated, it will be pulsed on and off quickly in a pseudo-random fashion. As the last UV LED is activated in each column, a cone of electromagnetic radiation 90 is shown being emitted from the UV LED.

Figure 9B:
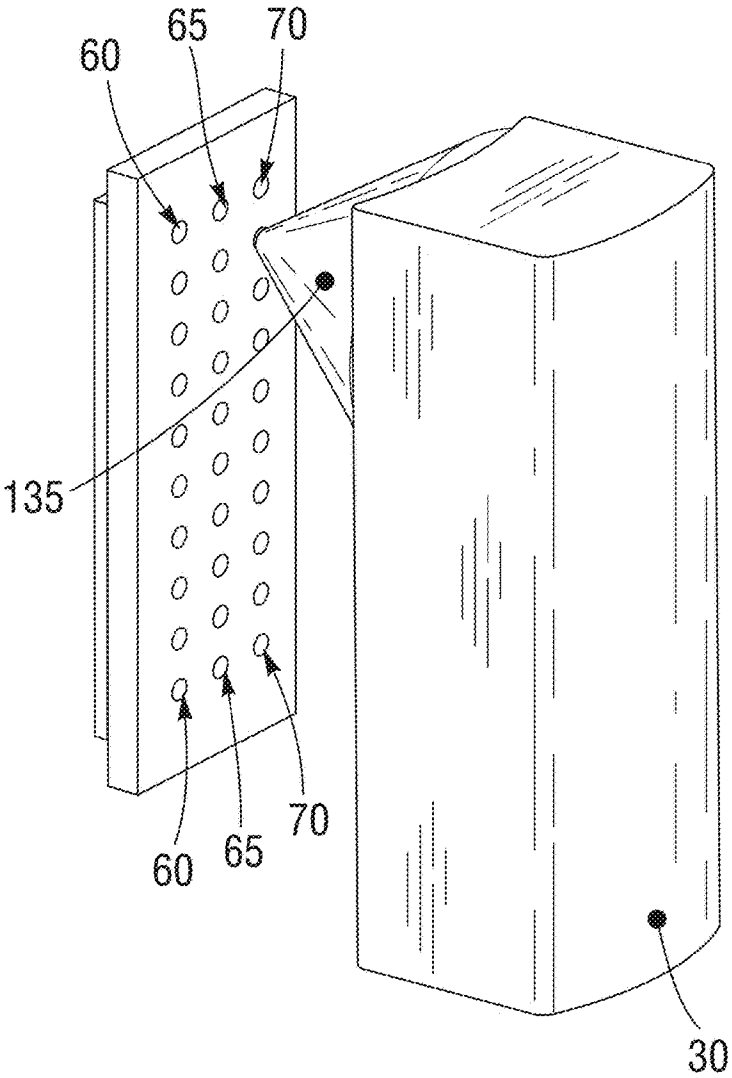
FIG. 9B is a drawing depicting the transparent section of the hand gun with the optically transparent window removed to show the LED's (with two actively illuminating the palm) as well as the optical sensors. There is also a representation of a section of a person's palm shown a short distance away from the gun grip.
Figure 9A:
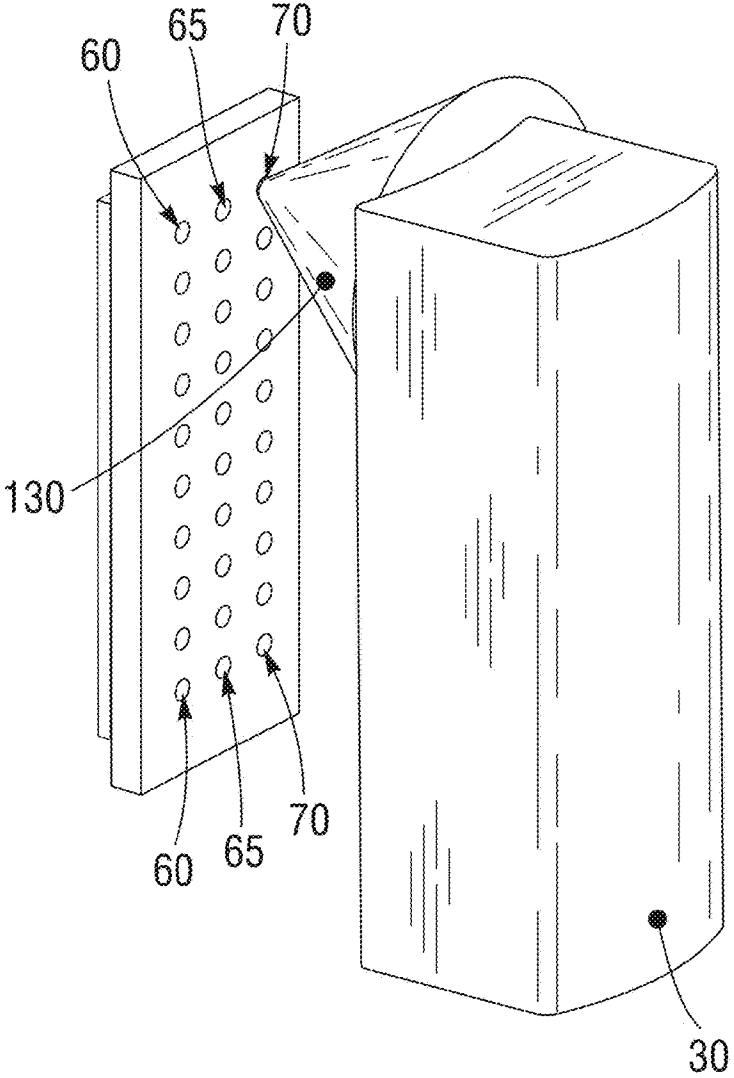
FIG. 9A is a drawing depicting the transparent section of the hand gun with the optically transparent window removed to show the LED's (with two actively illuminating the palm) as well as the optical sensors. There is also a representation of a section of a person's palm shown a short distance away from the gun grip.

FIGS. 9A and 9B detail a representative section of a person's palm 30 that is shown a short distance away from the LED's and electromagnetic sensors. The short distance is for the sake of clarity so the reader can see the LED's and electromagnetic sensors that would otherwise be blocked from view. In the preferred embodiment of the disclosed smart gun, there is more than one wavelength utilized. This is a security measure so that several different invisible inks could be utilized to thwart individuals from counterfeiting a bar-code like tattoo to operate an unauthorized hand gun. In the preferred embodiment of the disclosed smart gun, there are two columns of UV LED's, where each column has a different wavelength. In one column, the UV LED's 60 have one wavelength while the other column contains UV LED's 70 that have a slightly different wavelength. A column of electromagnetic sensors 65 would be placed between the two columns of UV LED's. It is important to note that the individual UV LED's will be strobed one at a time to conserve power. It is also important to note that when each UV LED is activated, it will be pulsed on and off quickly in a pseudo-random fashion. As one UV LED is activated "A", a cone of electromagnetic radiation 130 is shown being emitted from the UV LED. A short time later, the next UV LED in the column is activated, "B", and a cone of electromagnetic radiation 135 is shown being emitted from the UV LED. This process repeats with the next subsequent UV LED being activated until each of the two columns have had their individual UV LED's activated.

Figure 10:
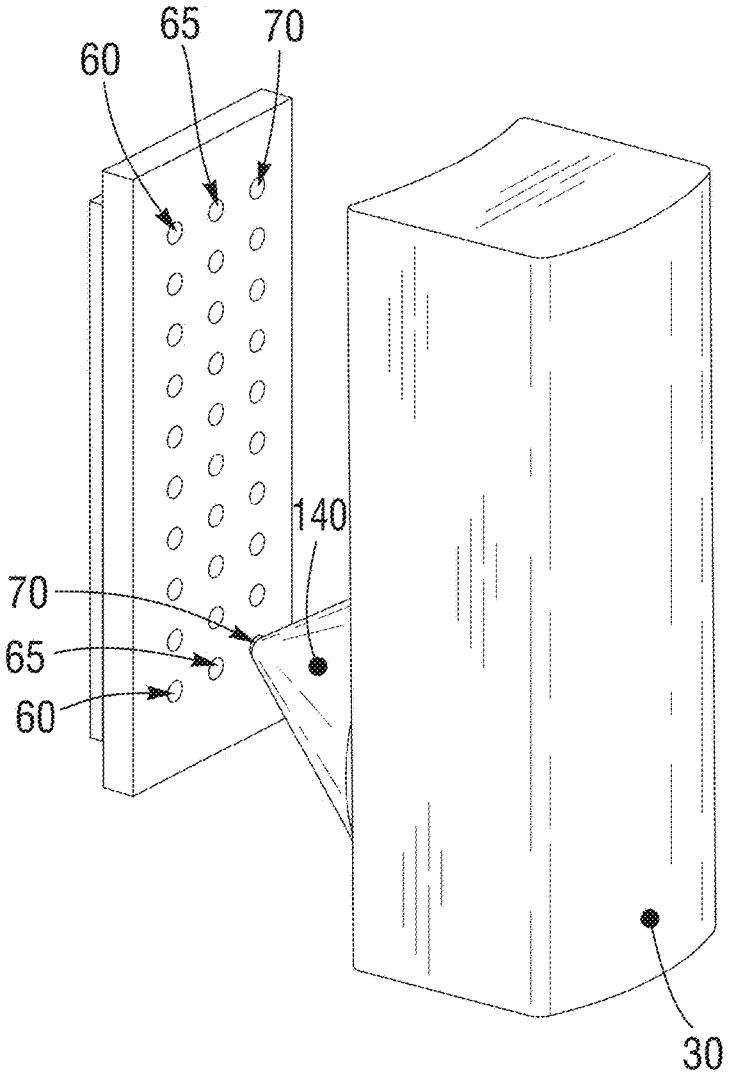
FIG. 10 is a drawing depicting the transparent section of the hand gun with the optically transparent window removed to show the LED's (with one actively illuminating the palm) as well as the optical sensors. There is also a representation of a section of a person's palm shown a short distance away from the gun grip.

FIG. 10 details a representative section of a person's palm 30 that is shown a short distance away from the LED's and electromagnetic sensors. The short distance is for the sake of clarity so the reader can see the LED's and electromagnetic sensors that would otherwise be blocked from view. In the preferred embodiment of the disclosed smart gun, there is more than one wavelength utilized. This is a security measure so that several different invisible inks could be utilized to thwart individuals from counterfeiting a bar-code like tattoo to operate an unauthorized hand gun. In the preferred embodiment of the disclosed smart gun, there are two columns of UV LED's, where each column has a different wavelength. In one column, the UV LED's 60 have one wavelength while the other column contains UV LED's 70 that have a slightly different wavelength. A column of electromagnetic sensors 65 would be placed between the two columns of UV LED's. It is important to note that the individual UV LED's will be strobed one at a time to conserve power. It is also important to note that when each UV LED is activated, it will be pulsed on and off quickly in a pseudo-random fashion. As the last UV LED is activated in each column, a cone of electromagnetic radiation 140 is shown being emitted from the UV LED.

Figure 11:
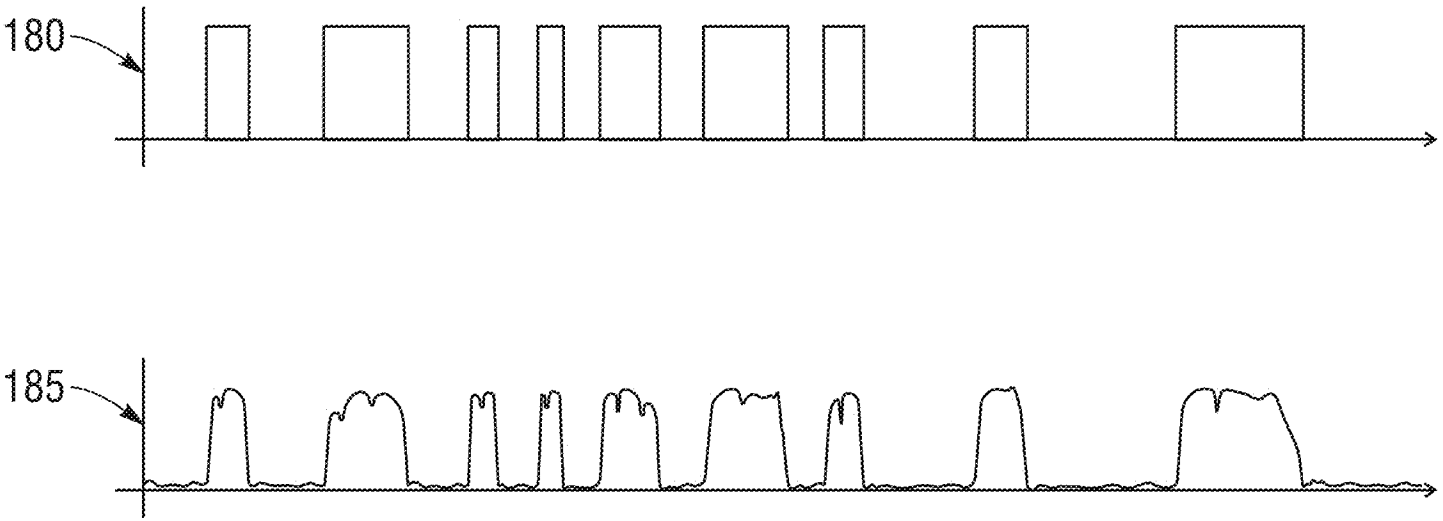
FIG. 11 is a plot depicting the activation voltage (upper) being delivered to the LED's over time and the analog response from the electromagnetic sensors (lower)

FIG. 11 shows two plots of electromagnetic sensor voltage over time. The upper plot 180 shows a pseudo-random voltage pattern that would be sent to one specific UV LED that is currently being strobed. Each UV LED that will be strobed will have a series of pseudo-random voltage patterns sent to it before the next consecutive UV LED is strobed. The pseudo-random pulses will be short duration pulses. In the preferred embodiment of the preferred smart gun, there will be three to five, two millisecond ($2\times10^{-3}$ second) pulses that will sent to each individual UV LED. It is important to note that the pulses will be transmitted to the columns of UV LED's as the gun is held in ones hand, and NOT before one pulls the trigger. There must not be any delay in the firing of the gun when the trigger is pulled. The disclosed patent will test for an authorized user when the gun is placed in the palm of the user, and NOT between each firing. An infrared LED can be added to the hand gun to determine if the hand gun has left the persons palm. Once the infrared LED determines that the hand gun is placed within a persons palm again, the pattern of UV LED's being strobed will once again commence. The lower plot 185 shows a typical pseudo-random voltage pattern that would be produced from the electromagnetic sensors that are housed between the UV LED columns. The electromagnetic sensors would be interrogated at intervals faster than that of the UV LED pseudo-random pattern. The reason for doing this is so that a person cannot defeat the security of the disclosed smart gun by simply shining a similar wavelength continuous light source into the transparent window in an attempt to fool the electromagnetic sensors. The signal from the interrogated electromagnetic sensors will be compared to that of the pseudo-random pattern for the UV LED's to see if they match. If the electromagnetic sensors are receiving strong amounts of UV or visible light when there should be none, the hand gun will remain disabled and rendered safe.

Figure 12:
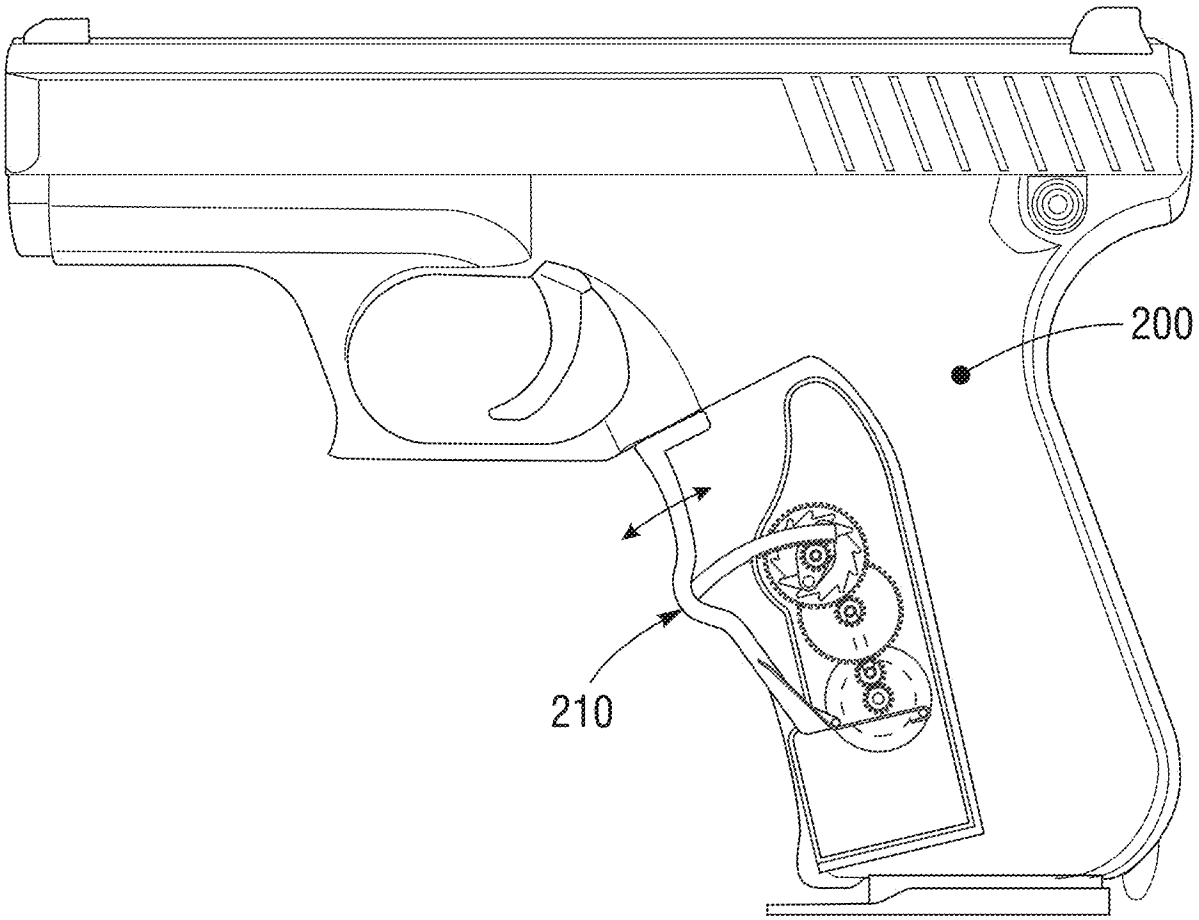
FIG. 12 is a drawing depicting a movable section of the gun grip that will produce power to activate the smart gun when repeatedly squeezed and released.

FIG. 12 shows a side view of a smart gun 200 that contains a built in generator. The problem with smart gun technology is that it needs power to operate. A smart gun owned by a residential household may be stored unused in a drawer for years at a time. During that long period of inactivity, any contemporary power source, such as a battery, may not be able to produce sufficient power to operate a smart gun if the internal battery voltage has dropped to a voltage level too low to operate the smart guns electronics. The smart gun 200 contains a movable section of gun grip 210 that can be repeatedly squeezed and released several times to produce power to successfully operate the smart gun. There are contemporary hand guns available on the commercial market that have a built in movable section of gun grip that acts as a mechanical safety to either enable the hand gun to fire or disable the hand gun. One popular such hand gun is the German made, Heckler & Koch model P7 hand gun. The Heckler & Koch model P7 utilizes a movable mechanical section of gun grip not for the purpose of providing a power source, but to act as a mechanical safety. The grip of this pistol features a built-in cocking lever activated by gripping the pistol handle. Before the Heckler & Koch model P7 hand gun can be fired, this lever must be squeezed. Thus this lever acts as a safety. The hand gun has an innovative trigger (with a squeeze cocking lever located at the front of the grip, beneath the trigger guard) and is striker fired. Squeezing the cocking lever with a force of 70 Newtons (15.7 pounds) cocks the firing pin. Once fully depressed, only two pounds of force are required to keep the weapon cocked. The weapon is then fired by pressing the single stage trigger rated at approximately 20 Newton (4.5 pound). As long as the lever is depressed, the H & K P7 hand gun fires like any other semi-automatic hand gun. If the lever is released, the hand gun is immediately de-cocked and rendered safe. This method of operation dispensed the need for a manual safety selector while providing safety for the user carrying the hand gun with a chambered round, and increased the speed with which the hand gun could be deployed and fired. Instead of utilizing this movable lever as a mechanical safety, the disclosed smart gun will utilize the moving lever action to produce power by rapidly rotating a series of gears attached to a small generator. When a person grabs their smart gun that has been stored for an extended period of time, the first thing they will do is to squeeze and release the movable lever of the gun grip several times to produce power for the smart gun. The smart gun can also utilize the same moving lever with gear reduction approach to produce power by connecting the trigger to a series of gears attached to a rotary generator. In this fashion, every time the smart gun is fired, the movement of the trigger will rotate a small generator that will produce power. The power can be stored in an internal rechargeable battery, or a high power density super-capacitor, or a combination of such. The smart gun can also have an internal coil of wires attached to an internal battery or super-capacitor that is kept in a "smart" holster that contains a large coil of wires that will be electromagnetically coupled when the smart gun is housed within the "smart" holster. This is a common way of charging smartphones through wireless coils. The "smart" holster can easily contain batteries connected to electronics that will produce a time varying voltage to allow power to be transferred to the smart gun.

A smart gun will require electrical power for user interrogation and for remote software updates, license renewal and verification, and for firing pin interrupt. A battery is the obvious solution, however, since a firearm may be stored for long periods of time without use, battery leakage and internal discharge effects could result in loss of firearm function or firearm safety functionality. The inventors disclose a means and method by which energy can be stored virtually indefinitely using scavenged kinetic energy derived from firearm cocking, slide cycling, or by a prior firing cycle. It is well known to those skilled in the art that in semi-automatic and automatic firearms, the recoil energy can be used to eject spent shells, load new cartridges, and hammer cocking. In such firearm configurations, it is common to employ a moving slide or bolt to compress an internal spring. In the disclosed smart gun, the recoil spring and/or an additional spring is incorporated into the smart firearm such that a magnet, electromagnet, or coil may be mounted such that the release of the compressed spring results in an electrical induction effect that produces electricity. The coil assembly may be mounted in the firearm frame with a magnetic assembly being part of the spring assembly, or the spring assembly may incorporate a coil and the magnetic assembly is mounted to the frame. In any case, the stored kinetic energy of a spring that was previously compressed by manual or firing slide or bolt cycling, can be applied, upon releasing such a compressed spring, to induce an electromotive force such that said electrical power can operate or inhibit the smart gun firing circuits. The release of the energy spring would preferably be timed to lag behind the firing pin spring to allow a time differential permitting smart gun circuit user identification or other system go/no go firing decision processing.

In another embodiment of the disclosed smart gun, the electrical power generator is incorporated into the firearm trigger assembly. The trend over the past twenty years has been to produce semi-automatic firearms that employ an internal firing pin striker in lieu of an external hammer, and to employ double action only trigger operation. For safety reasons, double action operation trigger pulls range anywhere from five to twelve pounds of force, using the Glock firearm as an example. The idea behind such a high trigger pull is to prevent accidental discharge. However, such high trigger pull forces favor the translation of human input kinetic energy into ample electrical power for smart gun electronics. Through the use of reduction gears, a long and heavy trigger pull can be translated into a high RPM or fast revolution rotary generator or dynamo operation. Adding a mass or flywheel would allow the generator to spin for a greater amount of time than would otherwise be necessary and producing power.

In another embodiment of the disclosed smart gun, a grip safety may be incorporated into the smart gun such that the gripping of the firearm induces a smart voltage for the interrogation/approval circuits. The grip safety may be a simple permanent magnet moving past a coil or vice versa, or, in a preferred embodiment, a reduction gear rotary generator. The proposed rotary generator is configured to translate linear or semi-linear motion into rotary motion suitable for electrical power generation. The preferred embodiment employs a permanent magnet type of DC generator, such as DC motor used in reverse as a generator. It is obvious to those skilled in the art that other generator configurations are possible, such as DC electromagnet generators and AC polyphase devices. Excess power can be stored in a supercapacitor, high energy density battery chemistry such as Lithium Ion, or other electrical energy storage device obvious to those skilled in the art.

In the disclosed smart gun, the identity of the user may be determined by using an invisible tattoo or other surface or sub surface skin marking. This marking may be applied to the palm of the hand used to fire a weapon. The marking is preferably a UV excitable interrogation of the skin to which UV fluorescing tattoo ink has been applied. The pattern may be a bar-code like or some other geographical pattern that is unique to the specific user. The rear of the firearm housing is configured to be an optically clear polymer or other window that permits the passage of the preferred wavelength of light for the firearm interrogation circuit with minimal attenuation. Identification of the bar code and, in the preferred embodiment, the infrared signature of a real person, can be a programmed function to permit weapon discharge. In another embodiment of the disclosed smart gun, a glove that incorporates the desired authorized pattern may be substituted for an actual hand.

Upon gripping the firearm and depressing a suitable grip safety, power is produced to activate the interrogation circuits, the UV and IR LED grip emitters, and UV and IR detectors or CCD cameras. Upon acceptable user authentication, any firing pin block or interrupt is disengaged. In another embodiment an electromagnetic firing pin is allowed to receive energy for weapon discharge.

In addition to the feature of identifying the user for firearm usage, is the ability of the disclosed smart gun to prevent possible future harm to children, civilians, and law enforcement. It has been held lawful by the courts that certain individuals may have to be licensed to carry, own, or purchase firearms. In some jurisdictions, a license to carry a firearm—if required—which must be renewed on a regular basis and which must be surrendered if the licensee is facing specific court action or who may be accused of domestic or other violence. Consequently, an individual who is deemed 'suitable' for firearm use today may not be considered suitable in the future. One can regulate firearms, but not the intended actions of people. A case in point is the Orlando shooter who in June of 2016 killed forty-nine people and injured fifty-three more at a nightclub. Another noteworthy case is the shooter at a school Sandy Hook, Conn. in 2012. In both instances, legally purchased firearms were used to create mass carnage. The arriving first responders faced possible harm even as they tried to stop the bloodshed. To protect first responders and other innocent civilians, a means to stop firearm use by those deemed presently unsuitable is needed.

In the preferred embodiment of the disclosed smart gun, the smart gun can be programmed to shut down if regular 'software updates' are not received. RF transmissions, such as WiFi, cellular, or Bluetooth, at periodic intervals can allow license renewals for smart gun operation to be received and which preclude gun shutdown. It is already commonplace for PC software users to have software that is in the 'Cloud' or which is purchased by subscription, necessitating regular authorization code download. If the firearm owner tries to shield the firearm from RF signals, the weapon will automatically shut down. Attempts to defeat the receiver circuits can be legislated to be felony tampering, analogous to tampering with a GPS home release ankle bracelet. The firearm may be in communication with a network. The network may be or include the Internet, World Wide Web, a local area network, or some other public or private computer, cable, telephone, cellular telephone system, client/server, peer-to-peer, or communication network or intranet. In some embodiments, the communication network can also include other public and/or private wide area networks, local area networks, wireless networks, data communications networks, or connections, intranets, routers, satellite links, microwave links, cellular or telephone networks, radio links, fiber optic transmission lines, ISDN lines, T1 lines, DSL connections, etc.

In yet another embodiment of the disclosed smart gun, the receiver section of the smart gun can be programmed to receive and activate a shutdown order. The received signal may be RF in nature, acoustic, optical, or other means obvious to those skilled in the art. The shut down functionality will be designed to be available for designated law enforcement responders. This ability would permit the gun used by a felon in the commission of a crime to have such a gun rendered inoperative. Relevant technology exists where police can use microwaves or other RF signals to render a car that is being pursued to be remotely shut down.

While the foregoing concepts disclosed by the present smart gun will no doubt encourage wide political debate that is outside the scope of a patent application, the disclosed concepts offer a means to seek a compromise solution for all parties involved. Present non-electronic firearms may be in the future still be allowed to be purchased and owned by civilians, but perhaps only by some higher level of licensing requirement, such as those that presently exist for Class II weapons such as machine guns, necessitation a Federal Firearms License or FFL. A lower threshold would then exist for a 'smart gun', allowing citizens the ability to protect themselves, families, and businesses. The proposed disclosed inventive technology would mitigate the probability of a future unsuitable person from causing wide spread carnage while simultaneously protecting law enforcement officers. The disclosed smart gun also offers instantaneous gun vetting and/or deactivation not possible with weapons now in existence. Manufacturers of smart gun technologies such as those presented herein may be afforded exemption from litigation similar to that afforded counter-terror device manufacturers under the DHS SAFETY Act established shortly after the terror attacks on September 2011. It should be understood that the disclosed smart gun can be adapted to all types of weapons in addition to hand guns. This includes rifles, shot guns, automatic weapons, land mines, missiles, rockets, hand grenades, RPG's (Rocket Propelled Grenades), to name just a few.

Figure 13:
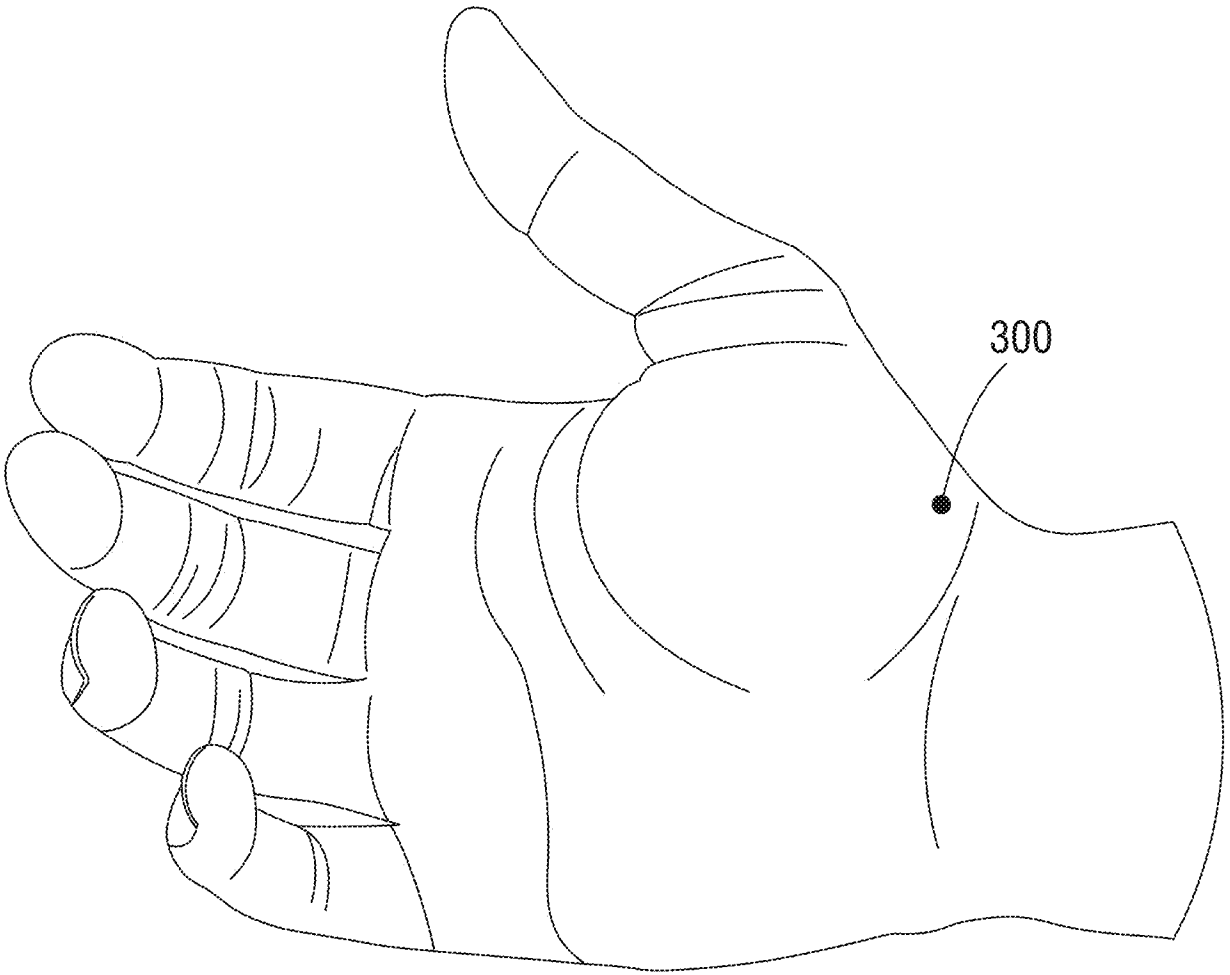
FIG. 13 is a drawing depicting a human hand that will eventually hold the smart gun as it would appear under visible light.

FIG. 13 shows a drawing of a human hand 300. On the surface of the human hand under visible light, there are many small lines and wrinkles that could be used to positively identify a specific individual. Just as a fingerprint can be used to positively match a known, fingerprint from a database to identify a specific individual, so can the surface features of a human hand be used to positively match a known, palm print from a database to identify a specific individual. If this is the only means of identification, the probability of matching a live palm print to a known pattern stored in a database would be pretty high; however, if the individual has had any hand surgery or scarring since the database pattern was stored, the probability of positively identifying a specific, unique individual would drop. What is needed is a second set of data to compliment the first.

Figure 14:
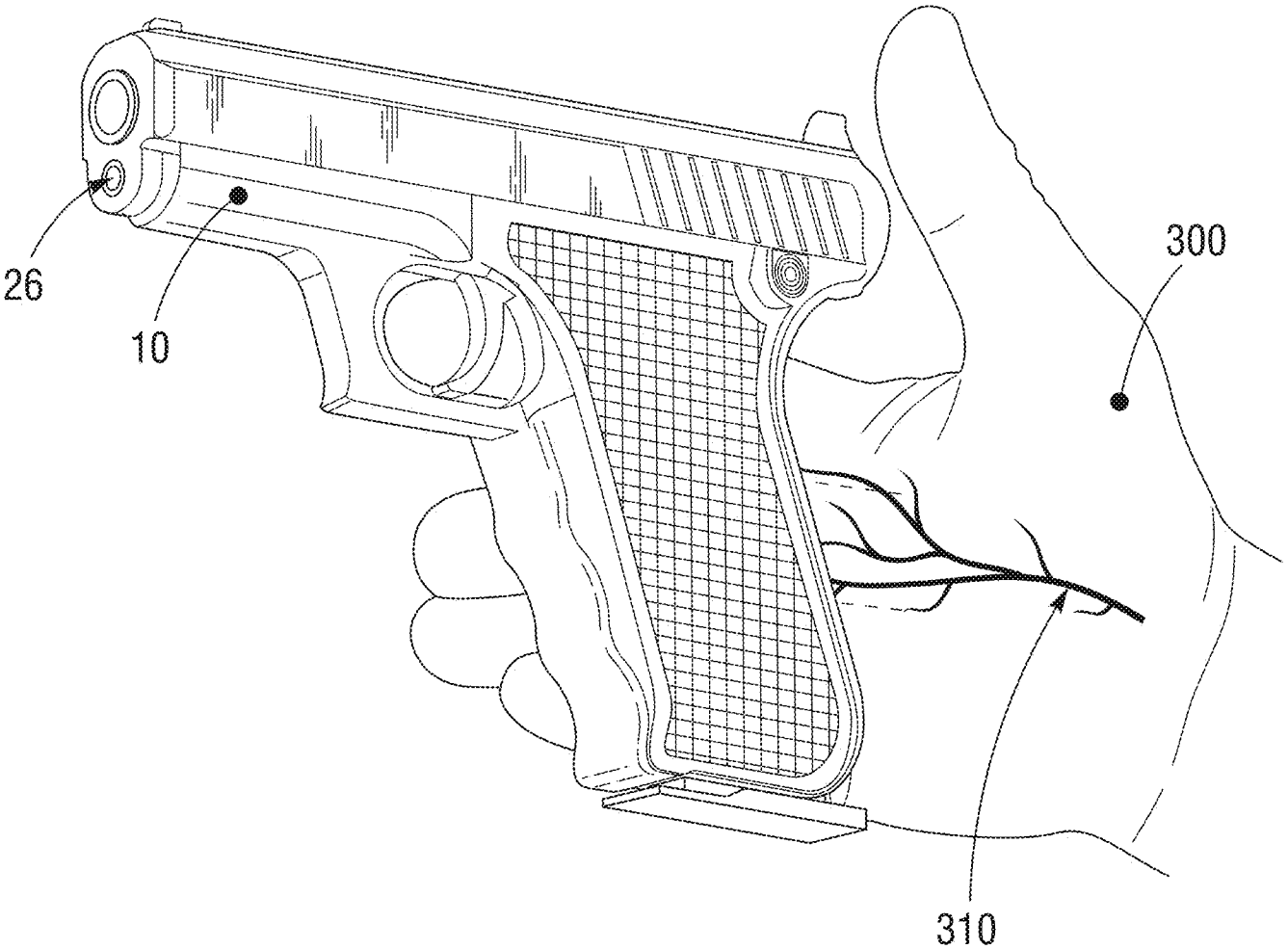
FIG. 14 is a drawing depicting a human hand that will eventually hold the smart gun as it would appear under a specific wavelength of infrared light in which the internal veins are visible.

FIG. 14 shows a drawing depicting a human hand 300. On the surface of the human hand, there are many small lines and wrinkles that could be used to positively identify a specific individual. Within the human hand, there are many veins 310 that are set in specific, unique patterns that can also be used to positively identify a specific individual. Although the veins 310 within the human hand are not visible to the human eye, they can become visible when illuminated with a light source that is in the infrared wavelength. Although even when the hand is illuminated with infrared light, the veins will still be invisible to the human eye, a CCD that is sensitive to infrared is required to produce a visible image. Fortunately, most CCD's are sensitive to infrared wavelengths and when used for visible wavelengths (such as in a webcam or a digital camera) an infrared filter is used to block the infrared wavelengths. Each of these patterns (surface lines and veinal structure) can be used as a unique fingerprint to perform a much greater positive identification to a specific, unique individual. The disclosed smart gun 10 contains a forward facing, narrow field of view electromagnetic sensor 26 that will be able to check for visible and invisible wavelengths of electromagnetic radiation that law enforcement agencies may use during coordinated operations. The forward facing, narrow field of view electromagnetic sensor 26 that will provide an analog signal to the smart guns microcontroller to make a positive identification as to if the electromagnetic signal is the result of a known law enforcement pattern stored in the smart guns database.

Figure 15B:
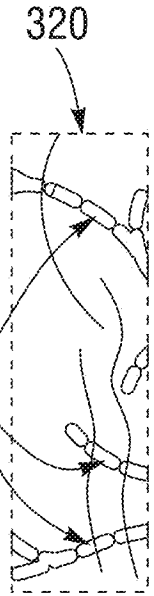
FIG. 15B is a drawing depicting a human hand detailing the section of the hand that would be interrogated by the smart gun's CCD as it would appear under a specific wavelength of infrared light in which the internal veins are visible.
Figure 15A:
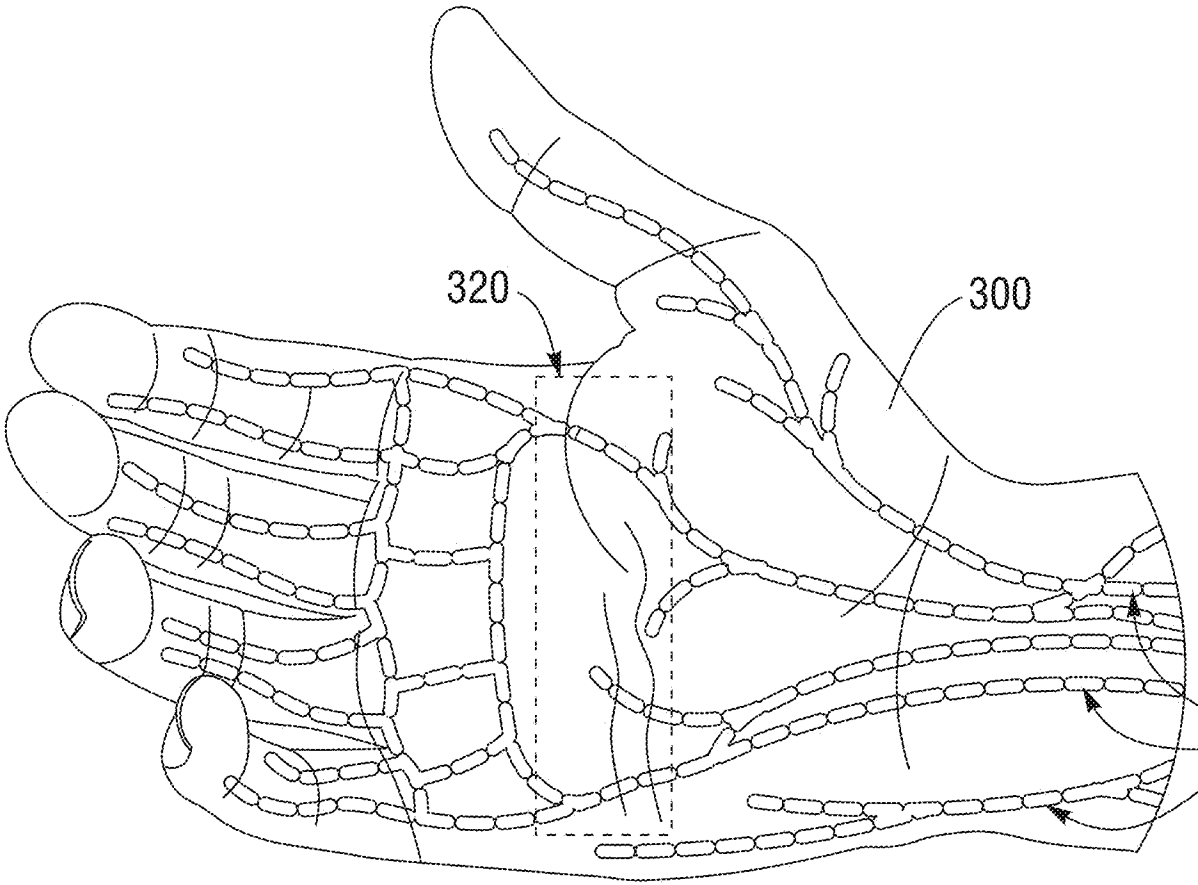
FIG. 15A is a drawing depicting a human hand that will eventually hold the smart gun as it would appear under a specific wavelength of infrared light in which the internal veins are visible.

FIG. 15A is a drawing depicting a human hand 300. FIG. 15B shows a detail of an optically interrogated section 320. As previously stated, the surface of the human hand contains many small lines and wrinkles that could be used to positively identify a specific individual. Within the human hand, there are many veins 310 that are set in specific patterns that can also be used to positively identify a specific individual. Although the veins 310 within the human hand are not visible to the human eye, they can become visible when illuminated with a light source that is in the infrared wavelength. Although even when the hand is illuminated with infrared light, the veins will still be invisible to the human eye, a CCD that is sensitive to infrared is required to produce a visible image. Most CCD's are sensitive to infrared wavelengths. Each of these patterns (surface lines and veinal structure) can be used as a unique fingerprint to perform a much greater positive identification to a specific, unique individual. The CCD can only optically interrogate a small section of the human hand corresponding to the rear section of the pistol grip 320. The CCD will be used to optically interrogate the small rectangular section of the human hand 320 that is illuminated with LED's of a specific wavelength. If the LED's are producing infrared wavelengths within the CCD's optical interrogation area, the vein structure will become distinguishable from that of the skin and muscle due to absorption of the infrared wavelengths. The rectangular optical interrogation area is depicted in FIG. 15B. This rectangular area 320 is what the CCD will be scanning when the smart gun is placed within a person's hand. The smart gun will contain enough memory to store a visible image palm print structure as well as the normally invisible vein structure 330 that is slightly larger than the rectangular optical interrogation area so that the patterns can be matched if the person holding the smart gun holds the firearm in a slightly different position each time. The process of storing a persons unique palm print and vein structure would be similar to how a person stores their finger print on a smartphone. The person sets their smartphone in a special finger print recognition mode and gently moves the specific finger or thumb around until enough data points are saved to perform a pattern match that will result in a high probability of uniquely identifying a specific individual. When the smart gun is put in a special pattern recognition mode, the CCD will image the visible palm print features, such as large lines and wrinkles, as well as imaging the vein structure as the person moves the smart gun in slightly different positions in the same hand. When a larger database of main hand features is stored in the smart gun, the probability of matching the rectangular optical interrogation section 320 to the stored database of features will be greater.

Figure 16B:
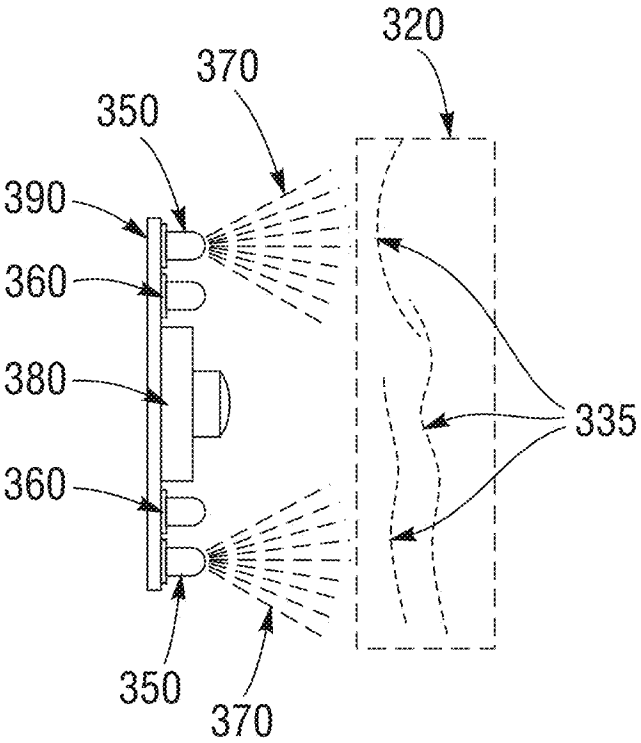
FIG. 16B is a drawing depicting a small rectangular section of an interrogated portion of a human hand under infrared and visible light, and the CCD and LED's that perform the optical interrogation within the smart gun.
Figure 16A:
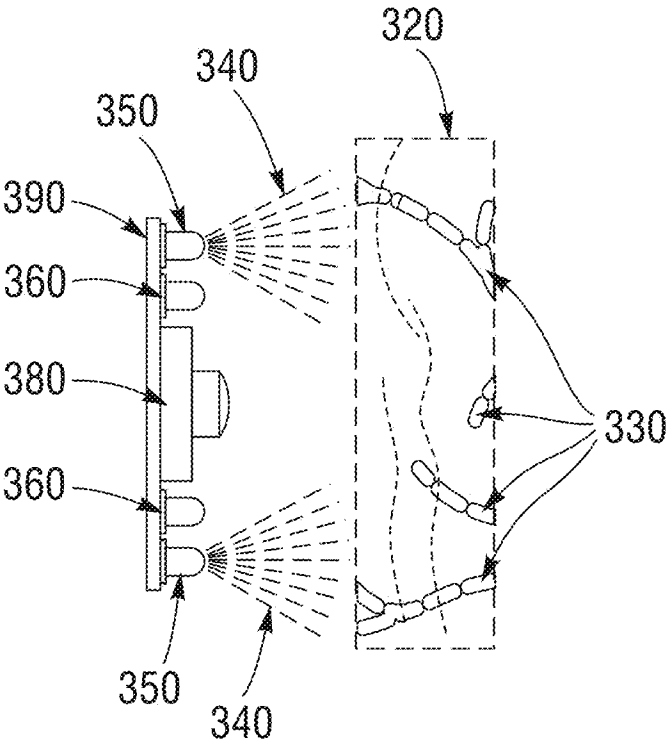
FIG. 16A is a drawing depicting a small rectangular section of an interrogated portion of a human hand under infrared and visible light, and the CCD and LED's that perform the optical interrogation within the smart gun.

FIGS. 16A and 16B show the optical components used to visualize invisible features of a human hand as well as the optical components required to visualize the visible features of a human hand. The surface of the human hand contains many visible lines and wrinkles 335 that could be used to positively identify a specific individual as well as invisible features such as the many veins 330 that are specific to a unique individual. These patterns can be used to positively identify a specific individual with a high probability. When the section of the hand is illuminated with infrared wavelengths of light 340 from LED's 350 suitable to show a discernable contrast difference between the normally invisible veins 330 and the skin within the optical interrogation window 320, an infrared and visible wavelength sensitive CCD 380 can save the optical image as a digital image to be compared with the smart guns database. This database is stored internally in the preferred embodiment of the disclosed smart gun, but can also be stored externally to the smart gun using wireless communication. When the digitized CCD image is compared with the database features, a partial comparison has been performed.

A second comparison is then performed by illuminating the same section of the hand with visible wavelengths of light 370 from LED's 360 suitable to illuminate the surface portion of the wrinkles and lines on the skin 335 within the optical interrogation window 320 (B), an infrared and visible wavelength sensitive CCD 380 can save the optical image as a digital image to be compared with the smart guns database. This database is stored internally in the preferred embodiment of the disclosed smart gun, but can also be stored externally to the smart gun using wireless communication. When the digitized CCD image is compared with the database features, a partial comparison has been performed. When the two databases are utilized together, a higher degree of probability of matching the smart gun to a specific, unique individual is realized.

Figure 17B:
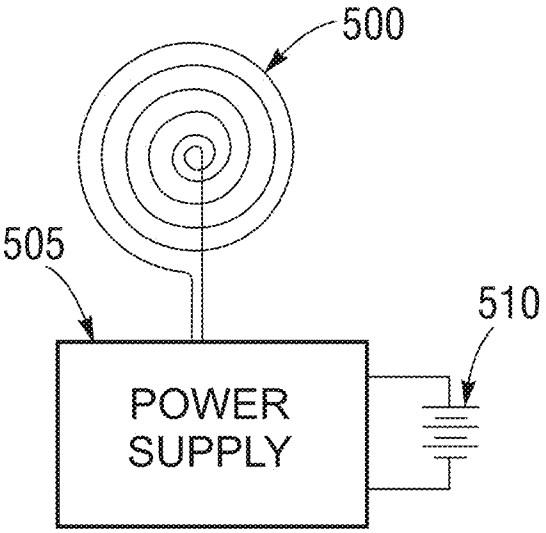
FIG. 17B is a drawing in block diagram form depicting the external charging unit.
Figure 17A:
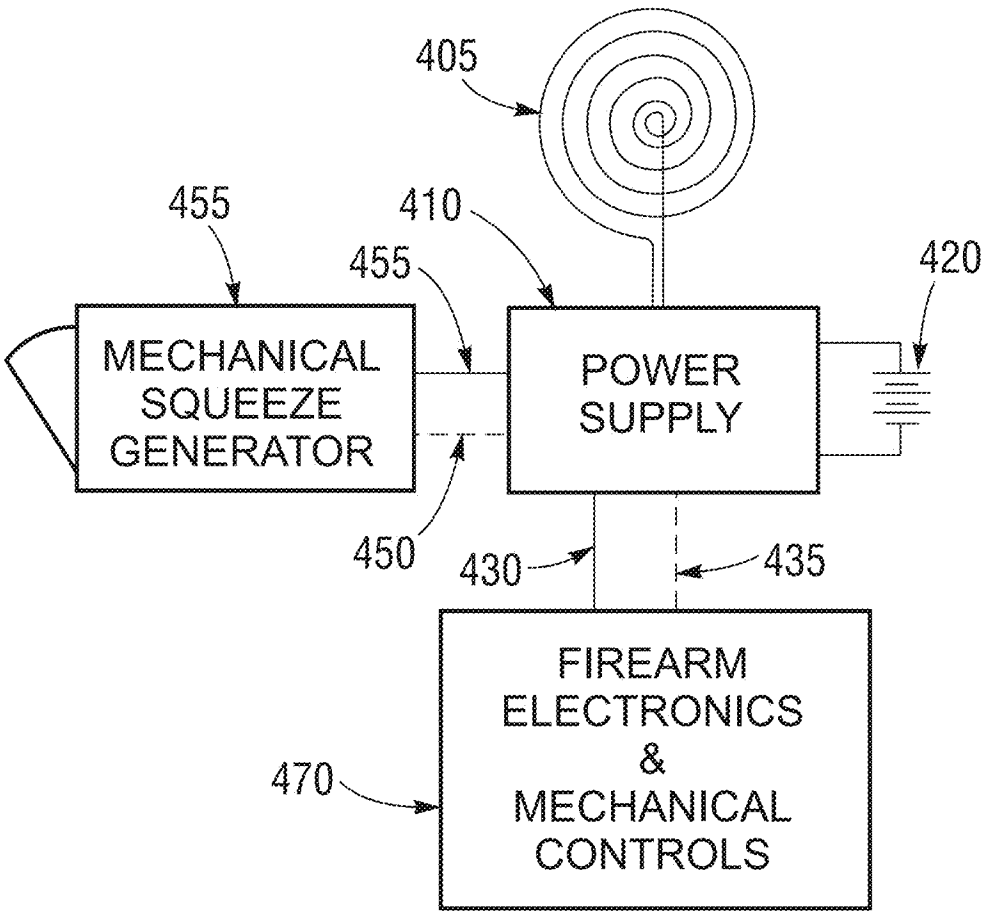
FIG. 17A is a drawing in block diagram form depicting the electronics and mechanical components required for the smart gun.

FIGS. 17A and 17B are schematic drawings depicting the electronic components required to operate the smart gun and perform an external charging if required. The drawing depicts the electronics contained within the body of the smart gun itself (FIG. 17A) as well as an external charging circuit (FIG. 17B) that can be resident in close proximity to the smart gun. The external charging circuit B can be built into a bolster, a storage safe, or within a vehicle. The external charger consists of a resonant inductive coil 500 that is connected to a power supply 505 and a rechargeable power storage device 510 such as a battery or a super capacitor. The electronics contained within the smart gun include a similar resonant inductive coil 405 that is connected to a power supply 410 and a rechargeable power storage device 420 such as a battery or a super capacitor. The power supply 410 provides power to the firearm electronics and mechanical controls 470. The mechanical controls incorporate a servo type device that will disengage the firearms firing pin; rendering the firearm unable to fire if the database palm print and vein structure do not match the features of the person holding the smart gun. The resonant inductive coil 405 can receive power from an external charger if the smart gun is positioned within close proximity (less than six inches) to the charging resonant inductive coil 500. If the smart guns internal power source 420 is fully charged, there will be no need for charging. If the user of the smart gun is not near an external charging source, and the internal power source 420 is completely discharged, a mechanical squeeze generator 455 will provide power by rapidly squeezing and releasing the lever several times in succession. Several power wires 445, 450 connect the power supply to the mechanical squeeze generator 455. There are several power wires 435, 430 that connect the firearm electronics and mechanical controls section 470 to the power supply 410.

Figure 18:
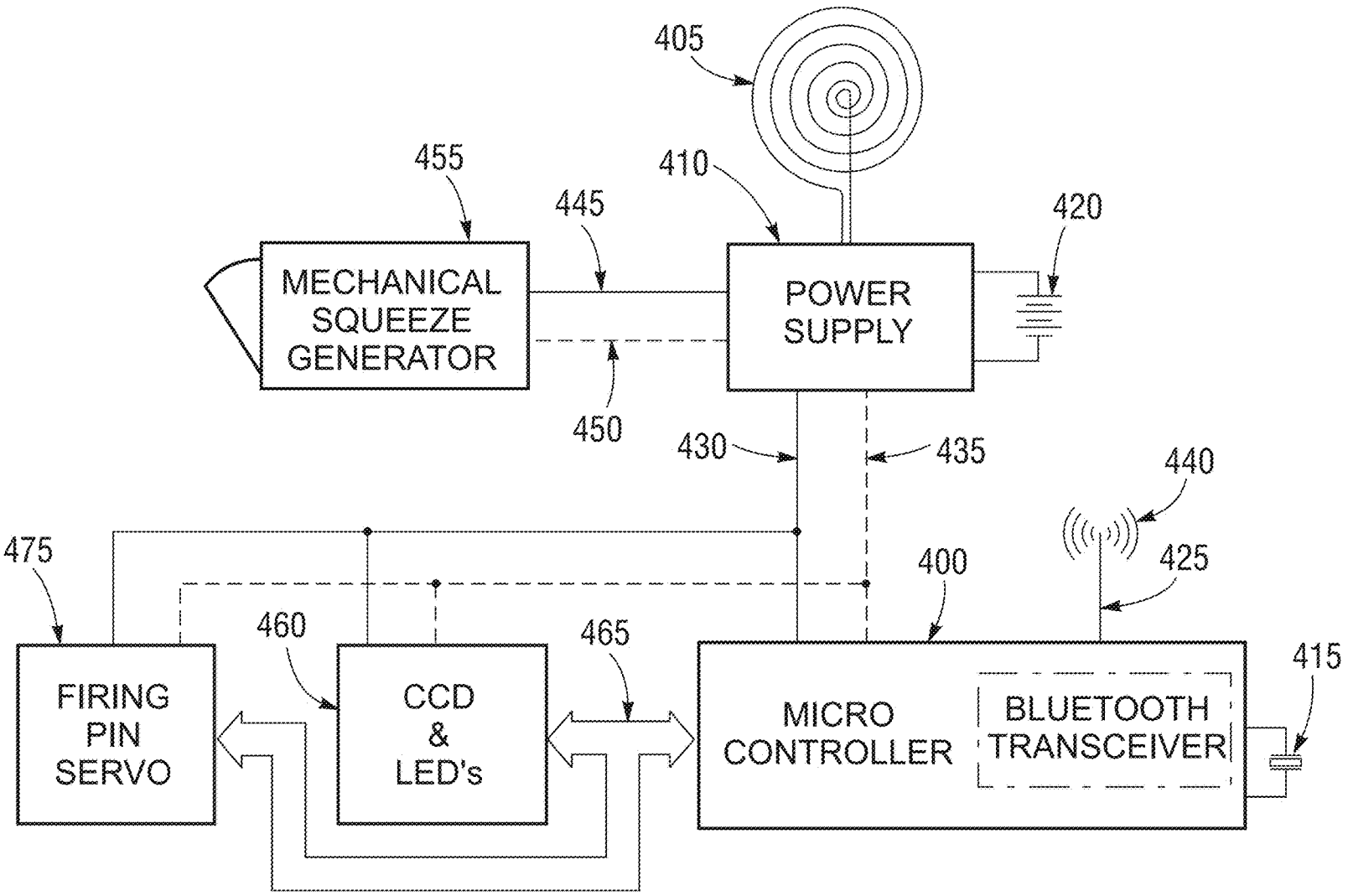
FIG. 18 is a drawing in block diagram form depicting the electronics and mechanical components contained within the smart gun.

FIG. 18 shows a drawing in block diagram form depicting the electronic components required to operate the smart gun. The electronics contained within the smart gun include a resonant inductive coil 405 that is connected to a power supply 410 and a rechargeable power storage device 420 such as a battery or a super capacitor. The power supply 410 provides regulated power for all the internal electronics and electromechanical components of the smart gun. The power supply 410 supplies two connections, one positive connection 430 and one negative or ground connection 435 to the internal electronics and the mechanical components. The CCD and LED section 460 consists of an infrared as well as visible wavelength CCD and a plurality of invisible wavelength and visible wavelength LED's. The individual LED's are activated by the microcontroller 400 as well as the operation of the CCD. The microcontroller 400 communicates with the CCD and LED's 460 as well as the electromechanical firing pin servo 470 through a bidirectional bus 465. All the timing operations of the microprocessor 400 are controlled by the crystal 415. The microcontroller 400 contains a Bluetooth transceiver that allows external communication through the use of a small Bluetooth antenna 425. It may happen that an authorized person may be using the smart gun in an unauthorized fashion, in this instance, an external individual such as a policeman, state trooper, or federal agent could remotely deactivate the smart gun so that no one get injured. There are instances where the police are called into domestic disturbance situation and an authorized user of a smart gun is threatening to use the smart gun in an unauthorized fashion. In situations like these, the smart gun can be safely deactivated by an authorized law enforcement agency before the law enforcement agent even enters the home.

The firing pin servo 475 consists of an electromechanical component that will disengage the firearms firing pin; rendering the firearm unable to fire if the database palm print and vein structure, or UV tattoo do not match the features of the person holding the smart gun. The resonant inductive coil 405 can receive power from an external charger if the smart gun is positioned within close proximity (less than six inches) to the charging resonant inductive coil 500. If the smart guns internal power source 420 is fully charged, there will be no need for charging. If the user of the smart gun is not near an external charging source, and the internal power source 420 is completely discharged, a mechanical squeeze generator 455 will provide power by rapidly squeezing and releasing the lever several times in succession.

Figure 19:
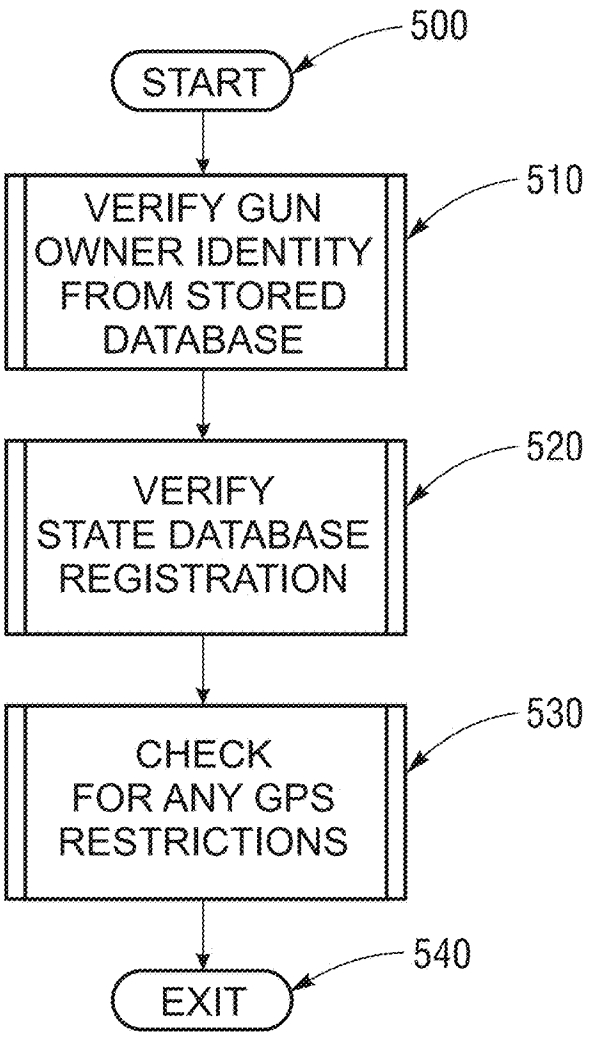
FIG. 19 is a drawing depicting a flowchart of the main operation of the smart gun.

FIG. 19 shows a drawing of a flowchart depicting the logical operation of the smart gun. A flowchart symbol indicates the start 500 of the main software routine. Within the flowchart operational sequence, there are three main subroutines that perform specific tasks that will result in the smart gun either being fully functional or fully or at least partially disabled, based upon the results of various logical computations. The three main subroutines are as follows, the owner identification subroutine 510, the state registration validity subroutine 520, and the GPS restricted coordinate check subroutine 530. When the three main subroutines have all been executed, the main portion of the software ends 540. Although the main portion of the software has ended, it is periodically entered through the use of a continually running real-time clock. The main routine will be started no more than about thirty times per second, and no less than about once per second, other times may be used in other embodiments.

Figure 20:
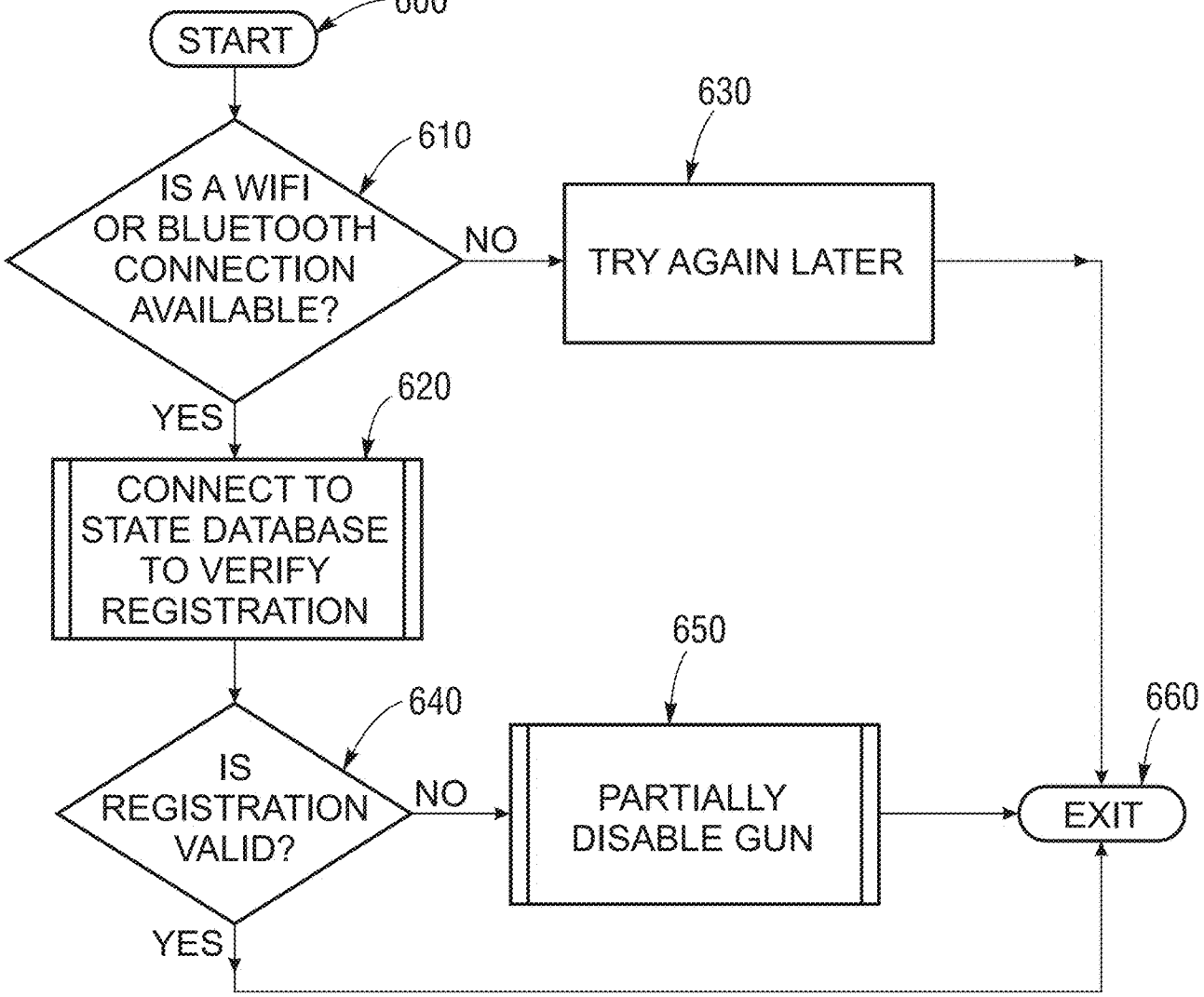
FIG. 20 is a drawing depicting a flowchart of the state registration check subroutine of the smart gun.

FIG. 20 shows a drawing of a flowchart depicting the logical operation of the state registration validity subroutine 520. A flowchart symbol indicates the start 600 of the state registration validity subroutine. The first thing to be done is to determine if there is communication with either a local WiFi or Bluetooth 610 so that communication can be established between the smart gun and the online state gun registration database. The smart gun can either communicate directly through a WiFi hotspot or through the Bluetooth of a smartphone or other compatible device in close proximity. Once communication is established between the smart gun and the online state gun registration database, a subroutine checks to see if the registered owner of the gun has a valid state registration 620. If communication cannot be established between the smart gun and a WiFi hotspot or by Bluetooth of a smartphone or other compatible device in close proximity, then it will periodically retry 630. If communication has been established with the online state gun registration database, and the result is that the gun owner of the specific smart gun (referenced by a unique electronic serial number) does have a valid registration in which no legal holds or restrictions have been placed upon it, this part of the routine has been passed 640. If; however, there are legal restrictions placed upon the state gun registration, the smart gun will be placed in a partially disabled status 650. A partially disabled status could be brought about by several reasons, including the following:

- The state has not received valid payment of the smart gun registration yet;
- The state has not had time to process the smart gun registration yet;
- There are legal warrants issued for the smart gun owner:
- The smart gun owner is wanted by state and local police;
- A legal injunction has been processed against the smart gun owner; and/or
- A restraining order has been processed against the smart gun owner.

In some cases, due to no fault of the part of the smart gun owner, mistakes or delays in state payment or state processing could occur. In this case the smart gun could still be used in a restricted manner for home self defense. A restricted manner would allow for a maximum number of shots to be taken within the home, but not a full clip to be expended. This would ensure that due to any payment or processing glitch on the states part, the smart gun owner would still be able to use their smart gun for home or self defense, but would not allow them to expend multiple clips of ammunition. Because the smart gun has GPS capability, the partially restricted smart gun would not allow the smart gun to fire when it is outside the boundaries of the house. When the software subroutine has been executed, the main portion of the software ends 660.

Figure 21:
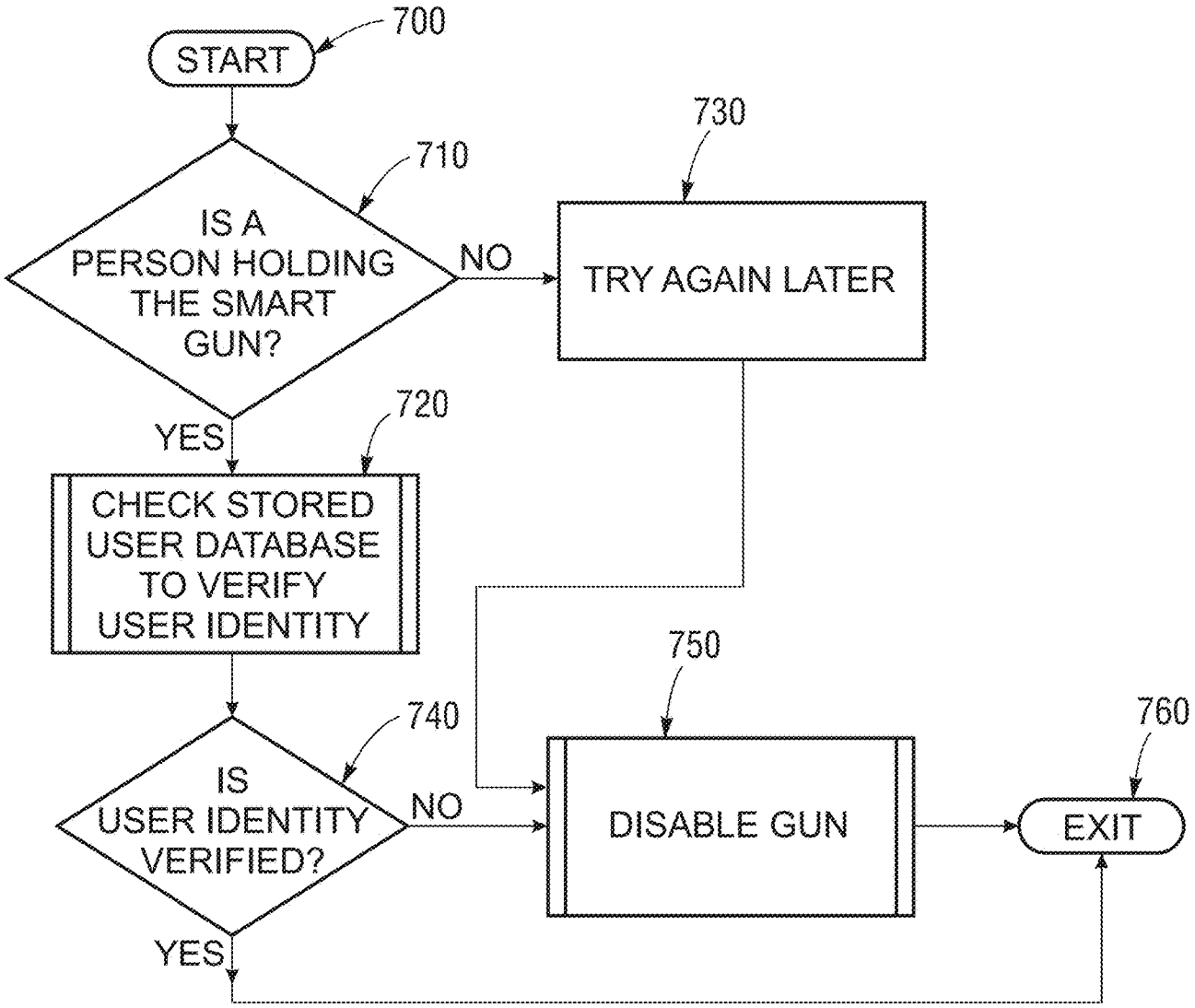
FIG. 21 is a drawing depicting a flowchart of the personal identity verification subroutine of the smart gun.

FIG. 21 shows a drawing of a flowchart depicting the logical operation of the smart gun owner verification subroutine 510. A flowchart symbol indicates the start 700 of the gun owner verification subroutine. The first thing to be done is to determine if a living person is holding the smart gun 710. This has previously been discussed as to how the smart gun analyzes the folds and creases of the surface or the skin, as well as the underlying vein structure and body heat measurements. There may be an instance where some low life has broken into the house and killed the smart gun owner, and is now trying to activate the smart gun by placing it in the deceased's hand. Since the home owner is deceased, the smart gun will determine this, and will disable itself, as well as contact the authorities via any WiFi or Bluetooth connection. The message sent to the authorities could be an electronic text message sent to 911 or the local and state police indicating that there is a smart gun owner that is deceased at some specific GPS coordinates and an unauthorized individual is trying to activate the smart gun. If a living person has been identified, the relevant identity verification parameters would then be compared to the smart guns internal database and a match would be determined within an acceptable margin or error 720. If the margin or error is outside the acceptable range, then the smart gun will disable itself since it has determined that the person holding the smart gun is not the registered owner 730 but because the smart gun owners has not been identified, the smart gun will remain disabled 750. If the living person has been identified, and the relevant identity verification parameters have been compared to the smart guns internal database, and a match has been determined to be within an acceptable margin or error, the smart gun will consider this the verified smart gun owner, and will enable the smart gun 740 before exiting the identity verification subroutine 760.

Figure 22:
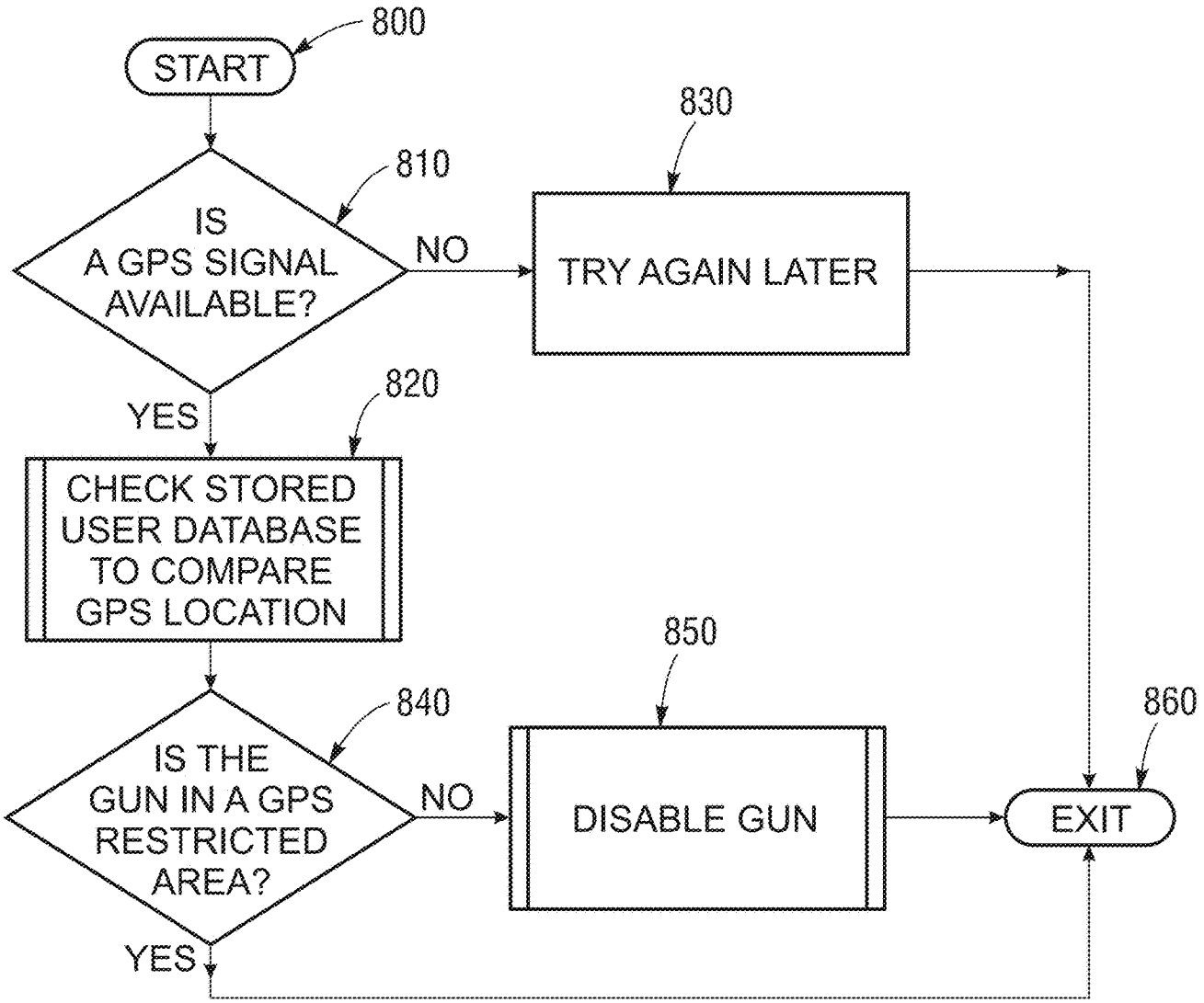
FIG. 22 is a drawing depicting a flowchart of the GPS restricted coordinate check subroutine of the smart gun.

FIG. 22 shows a drawing of a flowchart depicting the logical operation of the GPS restriction coordinates subroutine 530. A flowchart symbol indicates the start 800 of the GPS restriction coordinates subroutine. The first thing to be done is to determine if there is communication with any orbiting GPS satellites and a valid GPS signal has been logged into the smart gun 810. The GPS information may be read in from a person's Smartphone and communicated to the smart gun via Bluetooth. If no valid GPS coordinates could be established, the smart gun could use the "last known" valid GPS coordinates and make a calculated guess as to where the smart gun is at the moment based upon inertial sensor information from the smart gun. The inertial information from the smart gun will be in the form of accelerometer data and gyroscope data, so that position and rate information could help determine the actual GPS coordinates of the smart gun. If no valid GPS coordinates are known, then the software will try again after a short time, no more than thirty times per second, and no less than once per minute 830. If valid GPS coordinates are determined for the smart gun, the smart guns GPS coordinates are compared to a periodically updated, stored database of restricted GPS coordinates 820. An example of restricted GPS coordinates may include the following:

- The smart gun is within a school zone;
- The smart gun is within a federal building;
- The smart gun is within an airport;
- The smart gun is within a police station;
- The smart gun is within close proximity to the home address of a person who has filed a restraining order against the smart gun owner;
- The smart gun is within the GPS coordinates of a Presidential motorcade;
- The smart gun is within GPS coordinates of a business that they have just been fired from;
- The smart gun is within a moving vehicle; and/or
- The smart gun is on an airplane.

This is a non-exhaustive listing of only some of the criteria that will disable the smart gun based on GPS coordinates 840. If the smart gun is within any of these outlined GPS locations, the smart gun will be disabled 850. When the software subroutine has been executed, the main portion of the software ends 860.

Figure 23:
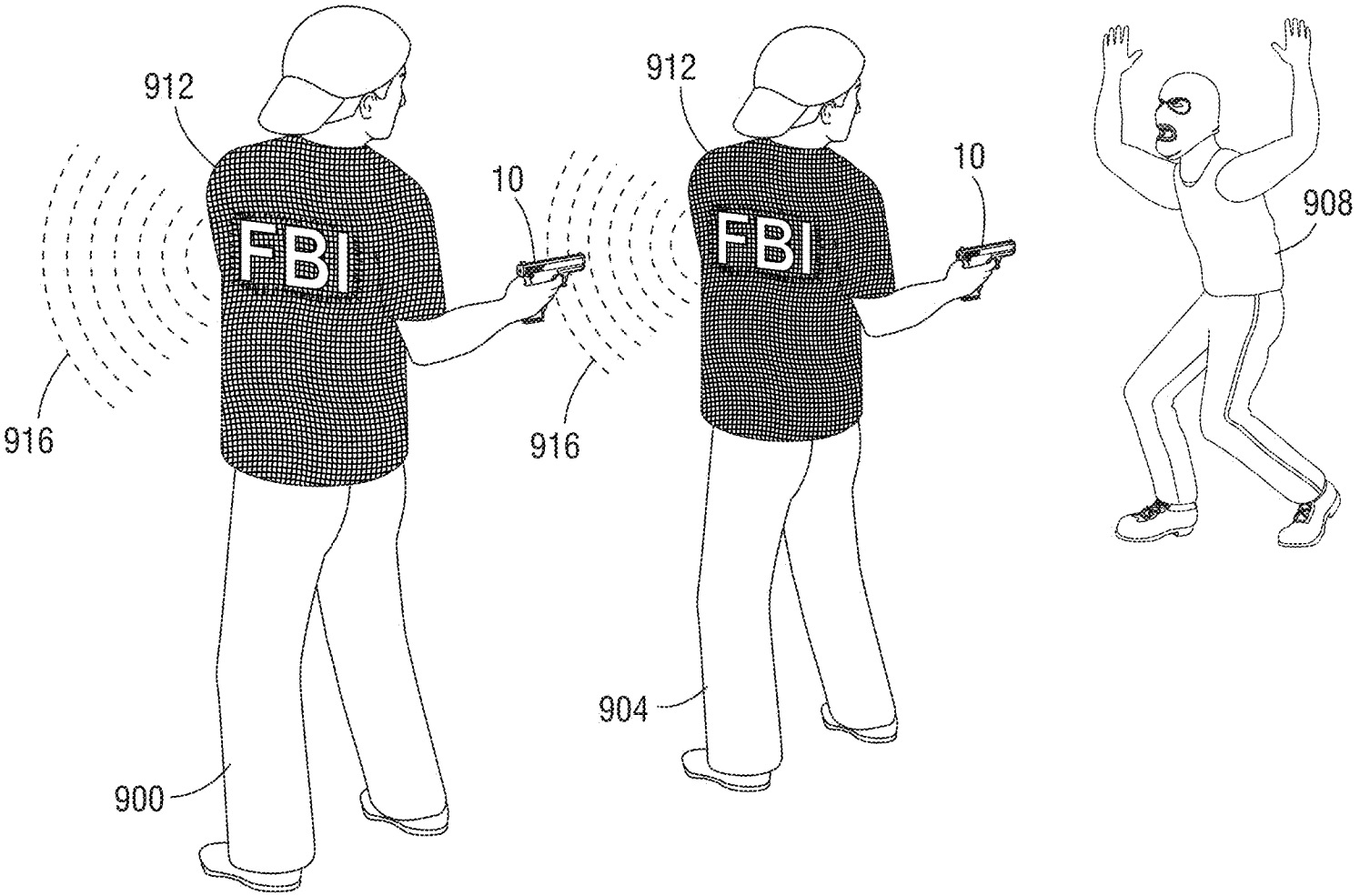
FIG. 23 is a view showing a precluded target embodiment of the smart gun.

Finally, in another embodiment, the disclosed smart gun may incorporate an optical sight which the smart gun programming can be configured to effect an IFF or 'Identification Friend or Foe' for law enforcement officers (LEO). If the smart gun is pointed at a LEO, an optical or other electronic 'badge' will preclude the smart gun from being capable of shooting the law enforcement officer or agent. In another embodiment of the disclosed smart gun, a similar "family member" badge, necklace, bracelet, or pendant can also be handed out to family members within a household. If a family member is wearing such an item, the smart gun will be prevented from accidentally firing when intentionally or unintentionally pointed at them. Referring to FIG. 23, a first FBI agent 900 and a second FBI agent 904 are shown each with their own disclosed smart gun 10. A bad guy 908 is shown. Each of the agents 900,904 have a badge 912. In one embodiment, the badge 912 may be attached to the clothing of the agents 900, 904. The badges 912 may be optical or electronic. If electronic, the badges may transmit a signal 916 that can be detected by the smart gun 10. The smart gun is configured to recognized the badge 912. If the bad 912 is recognized, the gun 10 will not fire when aimed at a person with the badge. However if the gun 10 is aimed elsewhere, such as the bad guy 908, and the bad guy does not have the badge 912, the gun will freely fire when the trigger is pulled. A person or object with one of the disclosed badges will be a "precluded target". The smart gun will not operate if pointed or aimed at a precluded target.

Throughout this patent application, numerous references may be made regarding servers, services, engines, modules, interfaces, portals, platforms, or other systems formed from computing devices. It should be appreciated that the use of such terms are deemed to represent one or more computing devices having at least one processor configured to or programmed to execute software instructions stored on a computer readable tangible, non-transitory medium. For example, a server can include one or more computers operating as a web server, database server, or other type of computer server in a manner to fulfill described roles, responsibilities, or functions. Within the context of this document, the disclosed smart phones, tablets, or hand held computers are also deemed to comprise computing devices having a processor and a non-transitory memory storing instructions executable by the processor that cause the device to control, manage, or otherwise manipulate the features of the disclosed apparatuses, systems and methods.

REFERENCE NUMERALS

FIG. 1:

10 Shows a 3-D CAD drawing of a semi-automatic hand gun.

20 Denotes an optically clear window that is transparent to the wavelengths used and will serve to protect the UV LED's as well as the electromagnetic sensors.

21 Denotes a tri-color led that will give safe, warning, and danger indications to the smart gun user.

22 Denotes a CCD camera that analyses the smart gun users face.

FIG. 2:

10 Shows a 3-D CAD drawing of a semi-automatic hand gun.

25 Denotes a portion of the palm where an invisible ink bar-code like tattoo will be placed.

26 Denotes a forward facing, narrow field of view electromagnetic sensor.

30 Denotes a portion of a person's palm.

FIG. 3:

10 Shows a 3-D CAD drawing of a semi-automatic hand gun.

26 Denotes a forward facing, narrow field of view electromagnetic sensor.

30 Denotes a representative portion of a person's palm.

FIG. 4:

20 Shows a 3-D CAD drawing of a portion of the gun grip's transparent window.

30 Denotes a representative portion of a persons palm.

40 Denotes a section of the electronics behind the transparent window that contain the LED's and the electromagnetic sensors.

FIG. 5:

25 Denotes a portion of the palm where an invisible ink bar-code like tattoo will be placed and is invisible to the naked eye.

30 Denotes a representative portion of a persons palm.

40 Denotes a section of the electronics behind the transparent window that contain the LED's and the electromagnetic sensors.

50 Denotes a portion of the palm where an invisible ink bar-code like tattoo will be placed and is currently rendered visible to an appropriately tuned electromagnetic sensor.

FIG. 6:

30 Denotes a representative portion of a persons palm.

60 Denotes a column of LED's of similar wavelength.

65 Denotes a column of electromagnetic sensors that are sensitive to the wavelength returned from the invisible ink.

70 Denotes a column of LED's of similar wavelength but sufficiently different from the other column of LED's.

FIG. 7:

30 Denotes a representative portion of a persons palm.

60 Denotes a column of LED's of similar wavelength.

65 Denotes a column of electromagnetic sensors that are sensitive to the wavelength returned from the invisible ink.

70 Denotes a column of LED's of similar wavelength but sufficiently different from the other column of LED's.

80 Denotes a cone like emission of electromagnetic radiation from one of the LED's that has been activated.

85 Denotes a cone like emission of electromagnetic eradiation from one of the LED's that has been activated at a later amount of time.

FIG. 8:

30 Denotes a representative portion of a persons palm.

60 Denotes a column of LED's of similar wavelength.

65 Denotes a column of electromagnetic sensors that are sensitive to the wavelength returned from the invisible ink.

70 Denotes a column of LED's of similar wavelength but sufficiently different from the other column of LED's.

90 Denotes a cone like emission of electromagnetic eradiation from one of the LED's that has been activated.

FIG. 9:

30 Denotes a representative portion of a persons palm.

60 Denotes a column of LED's of similar wavelength.

65 Denotes a column of electromagnetic sensors that are sensitive to the wavelength returned from the invisible ink.

70 Denotes a column of LED's of similar wavelength but sufficiently different from the other column of LED's.

130 Denotes a cone like emission of electromagnetic radiation from one of the LED's that has been activated.

135 Denotes a cone like emission of electromagnetic radiation from one of the LED's that has been activated at a later amount of time.

FIG. 10:

30 Denotes a representative portion of a persons palm.

60 Denotes a column of LED's of similar wavelength.

65 Denotes a column of electromagnetic sensors that are sensitive to the wavelength returned from the invisible ink.

70 Denotes a column of LED's of similar wavelength but sufficiently different from the other column of LED's.

140 Denotes a cone like emission of electromagnetic eradiation from one of the LED's that has been activated.

FIG. 11:

180 Shows a plot of an example of the pseudo-random voltage over time that is delivered to the LED's, one at a time.

185 Shows a plot of voltage over time that is produced from the electromagnetic sensors.

FIG. 12:

200 Shows a 2-D drawing of a smart gun that incorporates a movable section of the gun grip into the gun that will produce power to operate the smart gun.

210 Shows a 2-D drawing highlighting a portion of the smart guns movable section of the gun grip. As the gun grip is repeatedly squeezed and released, it will generate power.

FIG. 13:

300 Shows a 2-D drawing depicting a human hand that will eventually hold the smart gun as it would appear under visible light to the human eye.

FIG. 14:

10 Shows a 3-D CAD drawing of a semi-automatic hand gun.

26 Denotes a forward facing, narrow field of view electromagnetic sensor.

300 Shows a 2-D drawing depicting a human hand that will eventually hold the smart gun as it would appear under visible light.

310 Shows a 2-D drawing depicting the normally invisible veins that are located within the human hand.

FIG. 15:

300 Shows a 2-D drawing depicting a human hand that will eventually hold the smart gun as it would appear under infrared light.

310 Shows a 2-D drawing depicting a veins that are located within the human hand.

320 Shows a 2-D drawing of a rectangular region of the hand that would be interrogated by the smart guns CCD.

330 Shows a 2-D drawing depicting a veins that are located within the rectangular region of the hand that would be interrogated by the smart guns CCD.

FIG. 16:

320 Shows a 2-D drawing of a rectangular region of the hand that would be interrogated by the smart guns CCD.

330 Shows a 2-D drawing of the veins in the hand contained only within the rectangular region of the hand that would be interrogated by the smart guns CCD.

335 Shows a 2-D drawing of the lines and wrinkles in the hand contained only within the rectangular region of the hand that would be interrogated by the smart guns CCD.

340 Shows a series of dashed lines depicting infrared wavelengths of light emitted from the infrared wavelength LED's.

350 Shows a 2-D drawing that depicts infrared wavelength LED's.

360 Shows a 2-D drawing that depicts visible wavelength LED's.

370 Shows a series of dashed lines depicting visible wavelengths of light emitted from the visible wavelength LED's.

380 Shows a 2-D drawing that depicts a CCD.

390 Shows a 2-D drawing that depicts a PC board that contains the CCD and the LED's.

FIG. 17:

405 Shows a drawing depicting a resonant inductive coil that will be used to receive power transmitted from a matched resonant inductive coil.

410 Shows a block diagram drawing depicting the power supply electronics located within the smart gun.

420 Shows a schematic representation of a power source.

430 Shows a schematic representation of a positive power connection.

435 Shows a schematic representation of a negative or ground power connection.

445 Shows a schematic representation of a positive power connection.

450 Shows a schematic representation of a negative or ground power connection.

455 Shows a block diagram drawing depicting the mechanical squeeze generator that will generate power to the power supply.

470 Shows a block diagram drawing depicting the bulk of the firearm electronics and the electromechanical controls.

500 Shows a drawing depicting a resonant inductive coil that will be used to transmit power to a matched resonant inductive coil within the smart gun.

505 Shows a block diagram drawing depicting the power supply electronics located within the smart gun charger.

510 Shows a schematic representation of a power source.

FIG. 18:

400 Shows a block diagram drawing depicting the microcontroller.

405 Shows a drawing depicting a resonant inductive coil that will be used to receive power transmitted from a matched resonant inductive coil.

410 Shows a block diagram drawing depicting the power supply electronics located within the smart gun.

415 Shows a schematic representation of a crystal that will be used in conjunction with the microprocessor.

420 Shows a schematic representation of a power source.

425 Shows a schematic representation of a Bluetooth antenna.

430 Shows a schematic representation of a positive power connection.

435 Shows a schematic representation of a negative or ground power connection.

440 Shows a drawing that represents electromagnetic waves.

445 Shows a schematic representation of a positive power connection.

450 Shows a schematic representation of a negative or ground power connection.

455 Shows a block diagram drawing depicting the mechanical squeeze generator that will generate power to the power supply.

460 Shows a block diagram depicting the CCD and LED electronics.

465 Shows a drawing depicting a bidirectional communications bus between the microprocessor and the smart gun electronics.

475 Shows a block diagram drawing depicting the electromechanical controls that will interrupt the firearms firing pin.

FIG. 19:

500 Shows a flowchart symbol indicating the start of a routine.

510 Shows a flowchart symbol indicating the owner identification subroutine.

520 Shows a flowchart symbol indicating the state registration validity subroutine.

530 Shows a flowchart symbol indicating the GPS restricted coordinate check subroutine.

540 Shows a flowchart symbol indicating the end of a routine.

FIG. 20:

600 Shows a flowchart symbol indicating the start of a routine.

610 Shows a flowchart symbol indicating a decision block.

620 Shows a flowchart symbol indicating the connection to the online state gun registration database subroutine.

630 Shows a flowchart symbol indicating a routine to retry connecting to either WiFi or Bluetooth.

640 Shows a flowchart symbol indicating a decision block.

650 Shows a flowchart symbol indicating the partial disabling of the smart gun.

660 Shows a flowchart symbol indicating the end of a routine.

FIG. 21:

700 Shows a flowchart symbol indicating the start of a routine.

710 Shows a flowchart symbol indicating a decision block.

720 Shows a flowchart symbol indicating the identity verification process subroutine.

730 Shows a flowchart symbol indicating a routine to retry determining if a living person is holding the smart gun.

740 Shows a flowchart symbol indicating a decision block.

750 Shows a flowchart symbol indicating the disabling of the smart gun.

760 Shows a flowchart symbol indicating the end of a routine.

FIG. 22:

800 Shows a flowchart symbol indicating the start of a routine.

810 Shows a flowchart symbol indicating a decision block.

820 Shows a flowchart symbol indicating the determination if the smart gun is within restricted GPS coordinates subroutine.

830 Shows a flowchart symbol indicating a routine to retry determining the GPS coordinates.

840 Shows a flowchart symbol indicating a decision block.

850 Shows a flowchart symbol indicating the disabling of the smart gun.

860 Shows a flowchart symbol indicating the end of a routine.

REFERENCES

Ref. "Fluorescence and Phosphorescence." *Boundless Physics*. Boundless, 26 May. 2016. Retrieved 20 Jun. 2016 <https://www.boundless.com/physics/textbooks/boundless-physics-textbook/introduction-to-quantum-physics-28/applications-of-quantum-mechanics-183/fluorescence-and-phosphorescence-876-4913/>

What is claimed is:

1. A firearm, the firearm comprising:

a grip;

a transparent window located on the rear of the grip;

at least one electromagnetic sensor located within the grip, and configured to receive electromagnetic radiation from outside of the grip through the transparent window;

a computing device located in the grip and in communication with at least one LED and the electromagnetic sensor;

wherein the electromagnetic sensor is configured to detect incoming electromagnetic radiation traveling through the transparent window from outside of the grip; and the computing device is configured to allow the firearm to fire if the computing device determines that the incoming electromagnetic radiation corresponds to an authorized user for the firearm.

2. The firearm of claim 1, further comprising:

said at least one LED located in the grip, the LED configured to emit electromagnetic radiation from inside the pistol to outside of the pistol grip through the transparent window; and wherein the LED is configured to emit electromagnetic radiation onto a tattoo located on a palm of a user when the palm is adjacent or abutting the transparent window; and wherein the electromagnetic sensor is configured to detect electromagnetic radiation originating from the LED and reflected from the tattoo.

3. The firearm of claim 2, wherein the LED is configured to emit ultraviolet light, and wherein the tattoo comprises invisible ultraviolet ink such that the tattoo is not visible to humans.

4. The firearm of claim 3, wherein the invisible ultraviolet ink is reflective to only predetermined ultraviolet wavelengths.

5. The firearm of claim 1, wherein the electromagnetic sensor is configured to capture a thermal palm print of an authorized user of the firearm through the transparent window; wherein the electromagnetic sensor is further configured to detect the thermal palm print of a user when the palm is adjacent or abutting the transparent window; and the computing device is configured to allow the firearm to fire if the computing device determines that detected thermal palm print corresponds to the thermal palm print an authorized user for the firearm.

6. The firearm of claim 5, wherein the electromagnetic sensor is an infrared sensitive sensor.

7. The firearm of claim 1, wherein the electromagnetic sensor is a charged coupled device configured to capture the unique lines and folds of a palm of an authorized user of the firearm through the transparent window; wherein the electromagnetic sensor is further configured to detect the unique lines and folds of a palm of a user when the palm is adjacent or abutting the transparent window; and the computing device is configured to allow the firearm to fire if the computing device determines that detected unique lines and folds of a palm corresponds to the unique lines and folds of a palm an authorized user for the firearm.

8. The firearm of claim 1, further comprising:

a first LED located in the grip, the first LED configured to emit electromagnetic radiation of a first wavelength from inside the pistol to outside of the pistol grip through the transparent window;

a second LED located in the grip, the second LED configured to emit electromagnetic radiation of a second wavelength different from the first wavelength from inside the pistol to outside of the pistol grip through the transparent window;

wherein the first LED and second LED are configured to emit electromagnetic radiation onto a tattoo located on a palm of a user when the palm is adjacent or abutting the transparent window; and wherein the electromagnetic sensor is configured to detect electromagnetic radiation originating from the LED and reflected from the tattoo; wherein the tattoo comprises invisible ultraviolet ink such that the tattoo is not visible to humans, and wherein the invisible ultraviolet ink is reflective to only the first and second wavelengths of electromagnetic radiation.

9. The firearm of claim 8, wherein the first led is configured to produce a first pseudo random pulse of electromagnetic radiation, wherein the second led is configured to produce a second pseudo random pulse of electromagnetic radiation that occurs after the first pseudo random pulse has ended; and where the computing device is configured to compare the reflected pulses detected by the electromagnetic sensor to the first pseudo random pulse of electromagnetic radiation and the second pseudo random pulse of electromagnetic radiation and determines whether the reflected pulses matches stored electromagnetic signatures of an authorized user of the firearm.

10. The firearm of claim 1, further comprising:

a generator located in the grip;

a movable section located on the grip configured to be repeatedly squeezed and released by a user to actuate the generator to produce power for the computing device and electromagnetic sensor.

11. The firearm of claim 1, further comprising:

a generator located in the grip;

a recoil spring located in the firearm and configured to actuate the generator when the recoil spring is released to produce power for the computing device and electromagnetic sensor.

12. The firearm of claim 1, further comprising:

a generator located in the grip;

a trigger located on the firearm, the trigger configured to have a long and heavy trigger pull;

a reduction gear in operational communication with the trigger, and configured to actuate the generator when the trigger is pulled by the user thereby producing power for the computing device and electromagnetic sensor.

13. The firearm of claim 1, further comprising:

a generator located in the grip;

a grip safety located on the grip;

wherein the grip safety is configured to actuate the generator when the grip safety is activated, thereby thereby producing power for the computing device and electromagnetic sensor.

14. The firearm of claim 1, further comprising:

a transmitter/receiver located in the firearm and in signal communication with the computing device and a network;

wherein the firearm will become inoperable if regular software updates are not received and installed on the computing device.

15. The firearm of claim 1, further comprising:

a transmitter/receiver located in the firearm and in signal communication with the computing device and a network;

wherein the firearm will become inoperable if the receiver receives a shutdown order.

16. The firearm of claim 1, further comprising:

an optical sight located on the firearm and in signal communication with the computing device, wherein the computing device is configured to identify whether the firearm is pointed at precluded target, and if pointed at a precluded target the computing device will make the firearm inoperable.

17. The firearm of claim 1 wherein the electromagnetic sensor is a charged coupled device that can detect the vein patterns in a user's palm pressed up against the transparent window; and wherein the computing device can determine if the detected vein patterns correspond to an authorized user of the firearm and allow the firearm to operate.

18. A firearm system, the firearm comprising:

an external charging circuit, the external charging circuit comprising:

a resonant inductive coil;

a power supply in operable communication with the coil;

a rechargeable power storage device in operable communication with the coil;

a firearm configured to removably connect to the external charging circuit, the firearm comprising:

a resonant inductive coil;

a power supply in operable communication with the coil;

a rechargeable storage device in operable communication with the coil;

firearm electronics in operable communication with the power supply;

mechanical controls in operable communication with the power supply;

a mechanical squeeze generator in operable communication with the power supply.

* * * * *